US011857058B2

(12) United States Patent
Kobayashi

(10) Patent No.: US 11,857,058 B2
(45) Date of Patent: Jan. 2, 2024

(54) COSMETIC CONTAINER WITH SCRAPING MEMBER

(71) Applicant: TOKIWA CORPORATION, Nakatsugawa (JP)

(72) Inventor: Tatsuya Kobayashi, Kawaguchi (JP)

( * ) Notice: Subject to any disclaimer, the term of this patent is extended or adjusted under 35 U.S.C. 154(b) by 127 days.

(21) Appl. No.: 17/673,800

(22) Filed: Feb. 17, 2022

(65) Prior Publication Data

US 2022/0167727 A1 Jun. 2, 2022

Related U.S. Application Data

(63) Continuation of application No. PCT/JP2020/032907, filed on Aug. 31, 2020.

(30) Foreign Application Priority Data

Sep. 6, 2019 (JP) ..... 2019-162733

(51) Int. Cl.
*A45D 40/18* (2006.01)
*A45D 40/26* (2006.01)

(52) U.S. Cl.
CPC ..... *A45D 40/18* (2013.01); *A45D 40/26* (2013.01)

(58) Field of Classification Search
CPC ..... A45D 40/18; A45D 40/26; A45D 40/267; A45D 40/268; A45D 34/046; A45D 34/047; A45D 40/00; A45D 2040/0006; A45D 40/0081
USPC ..... 401/4, 121, 122, 126–130
See application file for complete search history.

(56) References Cited

U.S. PATENT DOCUMENTS 5,192,153 A * 3/1993 Gueret ..... A45D 40/265 401/129
5,700,100 A * 12/1997 Ackermann ..... A45D 40/267 401/122
6,568,405 B2 * 5/2003 Masuyama ..... A45D 34/046 401/122

(Continued)

FOREIGN PATENT DOCUMENTS

JP H5-034593 9/1993
JP 2003-125846 5/2003

(Continued)

OTHER PUBLICATIONS

International Preliminary Report on Patentability with Written Opinion dated Mar. 17, 2022 for PCT/JP2020/032907.

(Continued)

*Primary Examiner* — David J Walczak
(74) *Attorney, Agent, or Firm* — SOEI PATENT & LAW FIRM

(57) ABSTRACT

A cosmetic container includes an application body configured to hold a cosmetic and to apply the cosmetic to a surface, a container main body holding the application body, a cap detachably mounted on the container main body, a filling member, and a scraping member. The filling member is located inside the cap and forms a filling region to contain the cosmetic. The filling region has a diameter that is greater than a maximum diameter of the application body. The scraping member extends at least partially into the filling member to scrape the cosmetic stored in the filling region. The scraping member forms a tubular hole to insert the application body into the filling region.

14 Claims, 20 Drawing Sheets

(56) References Cited

U.S. PATENT DOCUMENTS

| | | | | |
|---|---|---|---|---|
| 7,686,528 | B2 * | 3/2010 | Gueret | A45D 40/265 401/129 |
| 2002/0182409 | A1 | 12/2002 | Gueret | |
| 2005/0175393 | A1 | 8/2005 | Tani | |

FOREIGN PATENT DOCUMENTS

| | | |
|---|---|---|
| JP | 2004-129953 | 4/2004 |
| JP | 2008-093239 | 4/2008 |

OTHER PUBLICATIONS

International Search Report dated Oct. 27, 2020 for PCT/JP2020/032907.

* cited by examiner

COSMETIC CONTAINER WITH SCRAPING MEMBER

CROSS-REFERENCE TO RELATED APPLICATIONS

This application is a continuation application of PCT/JP2020/032907, filed on Aug. 31, 2020, which claims the benefit of priority of Japanese Patent Application No. 2019-162733, filed on Sep. 6, 2019, the entire contents of which are incorporated herein by reference.

BACKGROUND

Japanese Unexamined Patent Publication No. 2004-129953 discloses a cosmetic container including a tip having a rod shape and forming a cosmetic application body, a holder having a bottomed cylindrical shape that holds the tip, and a cap body having a bottomed cylindrical shape that is screwed to and mounted on the holder. A male screw is formed in an outer peripheral surface of the holder, and a female screw is formed in an inner peripheral surface of the cap body. The female screw of the cap body is screwed to the male screw of the holder, so that the cap body can be mounted on the holder.

The cap body includes a tubular body in which the female screw is formed, and an end cap that closes an end of the tubular body. An inner tray filled with a cosmetic is provided inside the tubular body. The inner tray is provided in the vicinity of a center of the cap body in an axial direction, and the tip held by the holder is inserted into the cosmetic with which the inner tray is filled. A coil spring that biases the inner tray to a tip side is provided between the inner tray and the end cap. The inner tray filled with the cosmetic is biased to the tip side by the coil spring, so that the cosmetic abuts against the tip when the cap body is mounted on the holder. As a result, when the cap body is mounted, the cosmetic may adhere to the tip.

SUMMARY

The cosmetic container described above requires an increase in the amount of the cosmetic with which the inside of a filling member such as the inner tray is filled. Therefore, when a length of the filling member in the axial direction is increased, the filling member can be increased in depth, so that the amount of the cosmetic with which the inside is filled can be increased.

However, when the length of the filling member in the axial direction is increased, an overall length of the cosmetic container in the axial direction is increased in length, causing a poor portability of the cosmetic container as the cosmetic container may be inconvenient to carry.

When a size (e.g., a length) of the filling member in a radial direction is increased, a diameter of the filling member can be increased, so that the amount of the cosmetic with which the inside is filled can be increased. However, when the diameter of the filling member is increased, the diameter of the filling member is larger than a diameter of an application body such as the tip, so that the cosmetic is likely to remain in a radially outward portion inside the filling member. It may be more difficult for the application material to reach the radially outward portion inside the filling member, and consequently, it may be difficult for the cosmetic at the radially outward portion to adhere to the application body. As a result, it may be difficult to use up the cosmetic with which the filling member is filled, so that the cosmetic remaining in the filling member increases, in comparison to a filling member having a smaller diameter.

An example cosmetic container includes an application body configured to hold a cosmetic and to perform application, a container main body holding the application body, a cap detachably mounted on the container main body, a filling member having a bottomed tubular shape that is provided inside the cap and that is filled with the cosmetic, and a scraping member having a tubular shape that scrapes the cosmetic.

The filling member includes a bottom portion (or closed end) that the application body faces along an axial direction of the filling member. The bottom portion is provided with an increased diameter portion having a diameter larger than a maximum diameter of the application body. At least a part of the scraping member is provided inside the filling member. A tubular hole into which the application body is inserted toward the cosmetic in the axial direction is formed on an inner side of the scraping member.

In the example cosmetic container, the scraping member having a tubular shape scrapes the cosmetic with which the filling member is filled, and the cosmetic scraped by the scraping member adheres to the application body. The filling member includes the bottom portion that the application body faces in the axial direction, and the bottom portion is provided with the increased diameter portion having a diameter larger than the maximum diameter of the application body. The filling member includes the increased diameter portion having the diameter larger than the maximum diameter of the application body, so that the amount of the cosmetic to be filled can be increased. Since the amount of the cosmetic can be increased without increasing a length of the filling member in the axial direction, the cosmetic container is more convenient to carry so as to provide better portability. At least a part of the scraping member is provided inside the filling member. The scraping member has the tubular hole into which the application body is inserted toward the cosmetic. The scraping member scrapes the cosmetic inside the filling member, so that the cosmetic scraped by the scraping member can be more easily guided to the application body inserted into the tubular hole of the scraping member. Consequently, a greater quantity of the cosmetic may adhere to the application body, so that the residual amount of the filled cosmetic can be reduced.

An inclined surface may be formed on the inner side of the scraping member, the inclined surface being inclined radially inwardly and rearwardly, namely to an inside of the scraping member in a radial direction as the inclined surface extends away from the bottom portion of the filling member. In this case, the inclined surface is formed on the inner side of the scraping member. Since the inclined surface is inclined from an outer edge portion of the scraping member in the radial direction toward the application body inserted into the tubular hole, when the application body is pulled out from the cosmetic and from the scraping member to use the application body, the cosmetic is guided toward the application body along the inclined surface. Therefore, the scraped cosmetic can be guided to the application body along the inclined surface while the filled cosmetic is scraped by the scraping member, so that a greater quantity of the cosmetic may adhere to the application body. Consequently, a greater quantity of the cosmetic with which the filling member is filled may adhere to the application body, so that the residual amount of the filled cosmetic can be further reduced.

The scraping member may be movable in the axial direction and may be rotatable in a circumferential direction of the filling member with respect to the filling member, in order to more efficiently scrape the cosmetic in the filling member. Therefore, a greater quantity of the cosmetic may adhere to the application body, so that the residual amount of the filled cosmetic can be reduced.

The container main body may include a shaft portion holding the application body and extending from the application body in the axial direction, and the shaft portion may include first ratchet teeth. The scraping member may include second ratchet teeth with which the first ratchet teeth mesh. The first ratchet teeth and the second ratchet teeth may form a ratchet mechanism that allows a relative rotation between the shaft portion and the scraping member in a first direction and that restricts a relative rotation between the shaft portion and the scraping member in a second direction that is opposite the first direction. The scraping member may be restricted from rotating relative to the shaft portion by the ratchet mechanism, so as to rotate synchronously with the shaft portion to scrape the cosmetic. In this case, the first ratchet teeth provided in the shaft portion that holds the application body and the second ratchet teeth provided in the scraping member form the ratchet mechanism that allows a relative rotation between the shaft portion and the scraping member in the first direction. Since the ratchet mechanism allows relative rotation between the shaft portion and the scraping member in the first direction and restricts relative rotation in the second direction, the shaft portion and the scraping member rotate synchronously in the second direction. Since the synchronous rotation allows the scraping member to scoop the cosmetic, the cosmetic can be scraped with the rotation of the shaft portion, so that a greater quantity of the cosmetic may adhere to the application body.

Each of the second ratchet teeth of the scraping member may include a linear portion extending along the axial direction.

A length of the linear portion in the axial direction may be longer than a length of the linear portion in a circumferential direction of the scraping member.

The scraping member may include an elastic portion that is in contact with an inner surface of the filling member. Without the elastic portion, the cosmetic may leak out from a gap formed between the scraping member and the inner surface of the filling member depending on the type of the cosmetic. When the scraping member includes the elastic portion that is in contact with the inner surface of the filling member, as described above, the gap formed between the scraping member and the inner surface of the filling member can be filled or plugged by the elastic portion, so that leakage of the cosmetic can be more reliably suppressed.

The cosmetic container may include biasing means such as a biasing device, located inside the cap, to bias the filling member toward the container main body. In some cosmetic containers in which the container main body that holds the application body biases the application body toward a filling member, when application is performed, the application body may move and become unstable, and it may be difficult to apply the cosmetic in a suitable manner. When the biasing device that biases the filling member is provided inside the cap, as described above, there is no need to provide the biasing device in the application body, so that the application body can be fixed to the container main body. Therefore, the application body can be more readily stabilized, so that application of the cosmetic can be performed with more ease.

The bottom portion of the filling member may include a protrusion portion having a shape along an outer shape of the application body and protruding away from the container main body. In this case, the protrusion portion provided in the bottom portion of the filling member has a shape conforming to the outer shape of the application body. Therefore, the application body is inserted into a portion inside the protrusion portion, so that a greater quantity of the cosmetic inside the filling member may adhere to the application body and deformation of the application body caused by the insertion of the application body into the inside of the protrusion portion can be suppressed.

DETAILED DESCRIPTION

Hereinafter, examples of a cosmetic container will be described with reference to the drawings. In the following description, with reference to the drawings, the same reference numbers are assigned to the same components or to similar components having the same function, and overlapping description is omitted.

Figure 1:
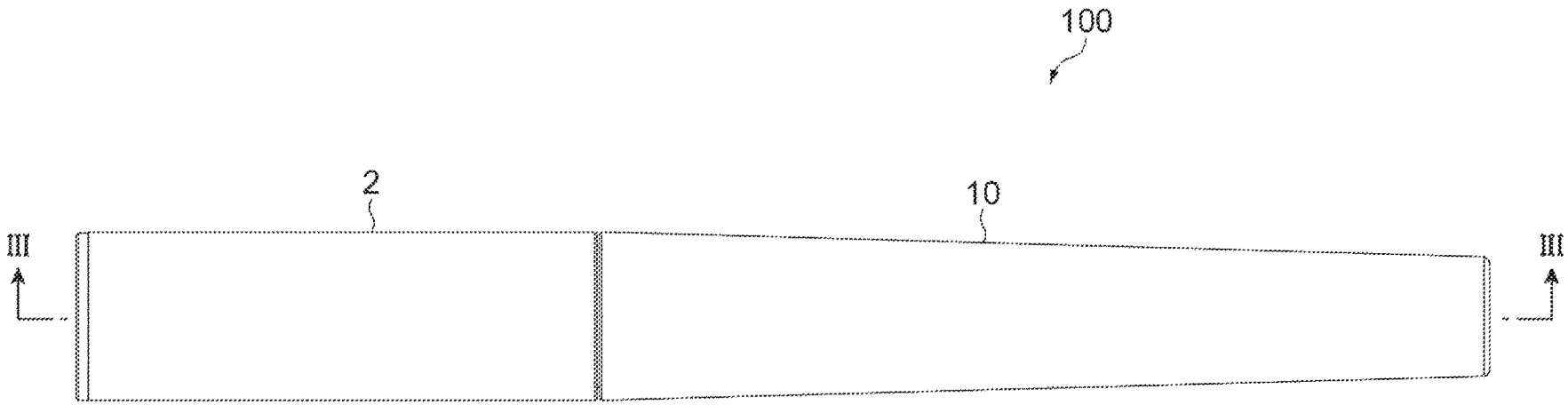
FIG. 1 is a side view illustrating a cosmetic container according to an example.
Figure 2:
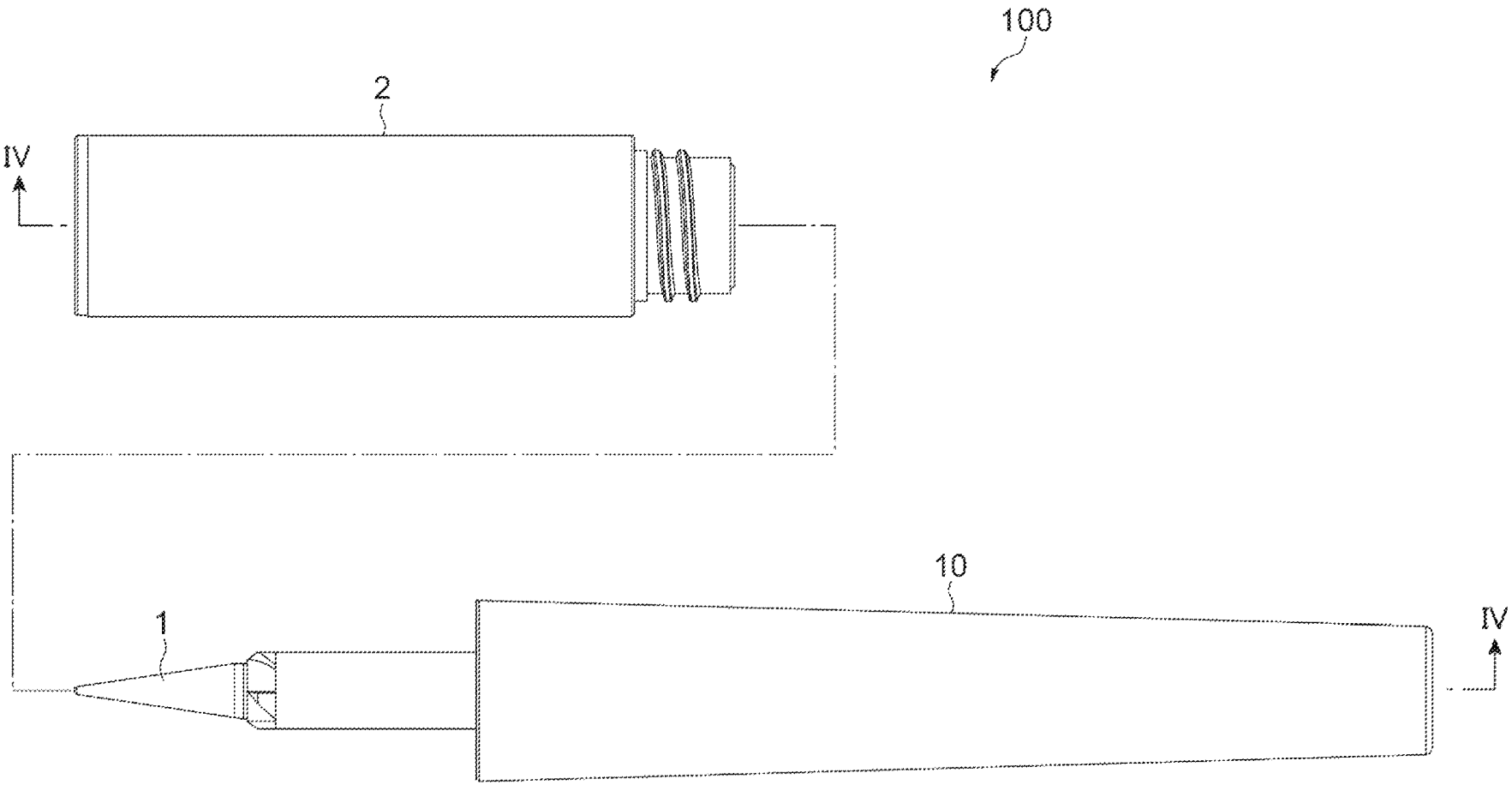
FIG. 2 is a side view illustrating a state where a container main body is removed from a cap of the example cosmetic container of FIG. 1.

FIG. 1 is a side view of an example cosmetic container. FIG. 2 is a side view of the cosmetic container, illustrating a state in which a cap is removed. With reference to FIGS. 1 and 2, the example cosmetic container 100 contains a cosmetic M (cf. FIG. 3A and FIG. 3B), and includes an application body 1 with which a user may apply the cosmetic M to a surface. The application body 1 is made of, for example, nitrile butadiene rubber (NBR) or polyamide resin (PA).

The application body 1 is provided to hold and apply the cosmetic M. The cosmetic M is contained inside a cap 2 of the cosmetic container 100. The cosmetic container 100 is configured such that a container main body 10 including a sleeve 12 holds the application body 1.

The cosmetic container 100 is configured such that application can be immediately performed by the application body 1 in a state where the application body 1 of the container main body 10 is removed from the cap 2.

The cosmetic M is, for example, an eyeliner, an eyebrow liner, a lip gloss, a concealer, a beauty stick, or a nail pen. A soft cosmetic material (semisolid phase, soft phase, gel phase or the like) can be used as the cosmetic M.

The cosmetic container 100 may have a substantially cylindrical shape, for example, extending in an axial direction D1 in which an axis L extends. In the present disclosure, the "axis" refers to a center line of the cosmetic container extending along a longitudinal direction of the cosmetic container. The "axial direction" refers to a direction along the axis of the cosmetic container (for example, the longitudinal direction of the cosmetic container 100). When viewed from the container main body 10 in the cosmetic container 100, a direction in which the cap 2 is provided may be described as "front" or "forward", and an opposite direction may be described as "rear" or "rearward". Namely, a direction in the axial direction D1 extending from the container main body 10 toward the cap 2 may be referred to a "forward" direction and a direction in the axial direction D1 extending from the cap 2 toward the container main body 10 may be referred to a "rearward" direction. Additionally, the cap 2 may be considered to be positioned at a front side of the container main body 10 and the container main body 10 may be considered to be positioned at a rear side of the cap 2. Such positions and directions are intended for the convenience of description, and do not limit the positions, the orientations and the like of components or portions described.

Figure 3A:
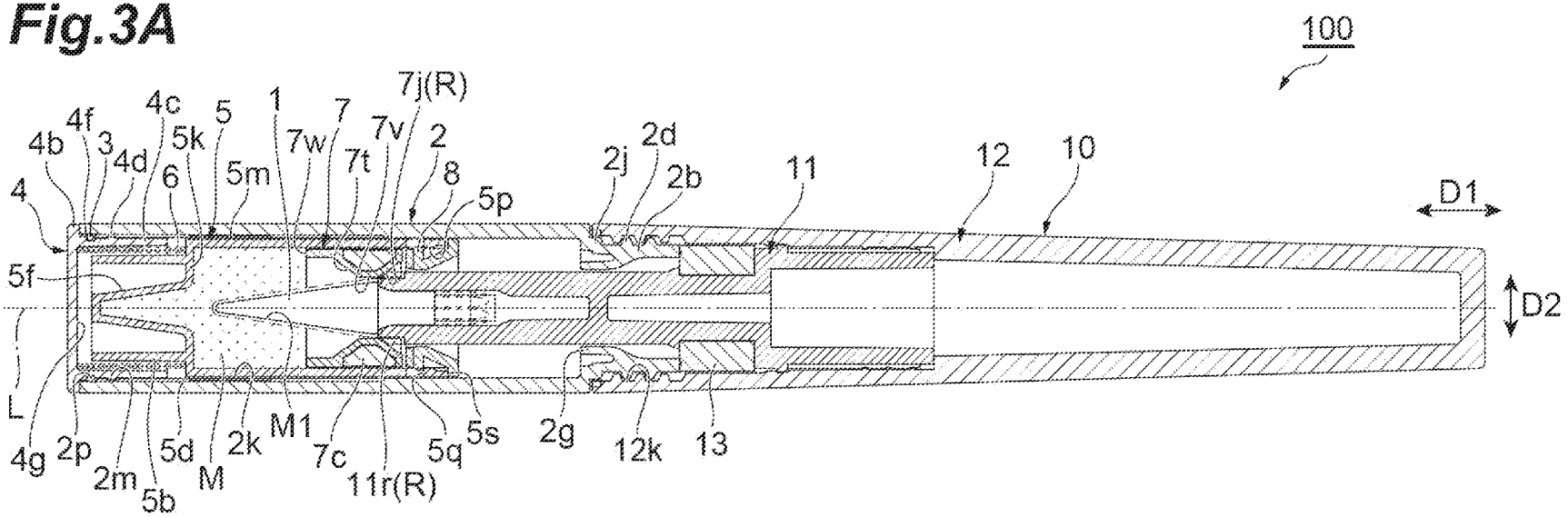
FIG. 3A is a cross-sectional view of the cosmetic container of FIG. 1 taken along line III-III.
Figure 3B:
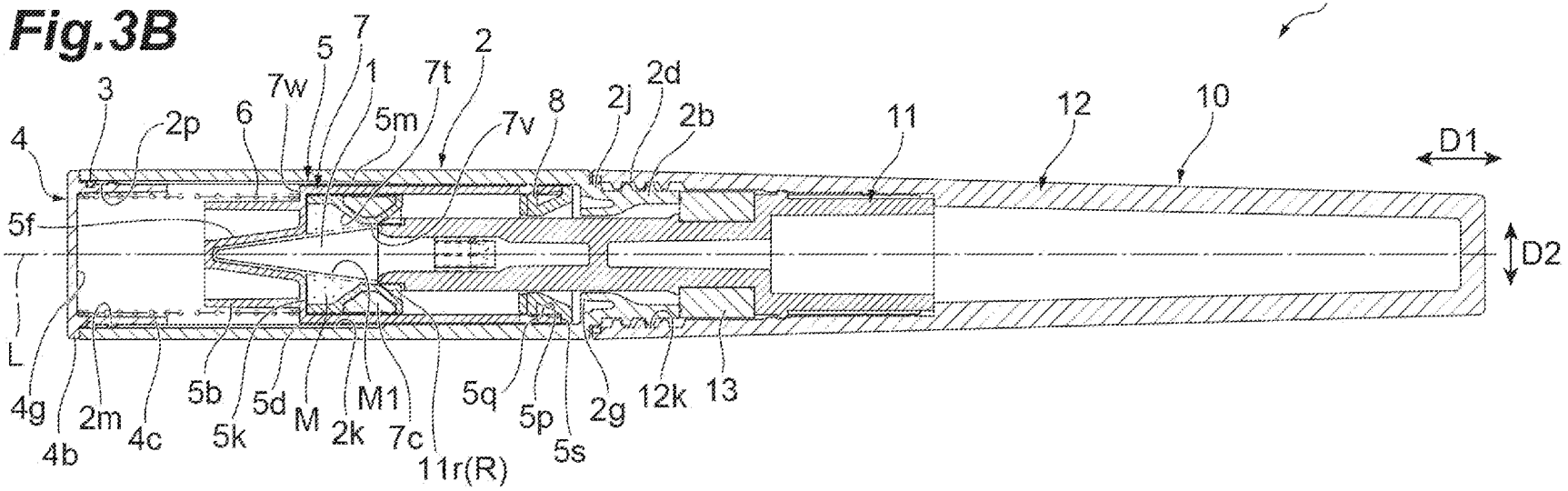
FIG. 3B is another cross-sectional view of the cosmetic container of FIG. 3A, illustrating a state in which an amount of a cosmetic contained in the cosmetic container has decreased.
Figure 4:
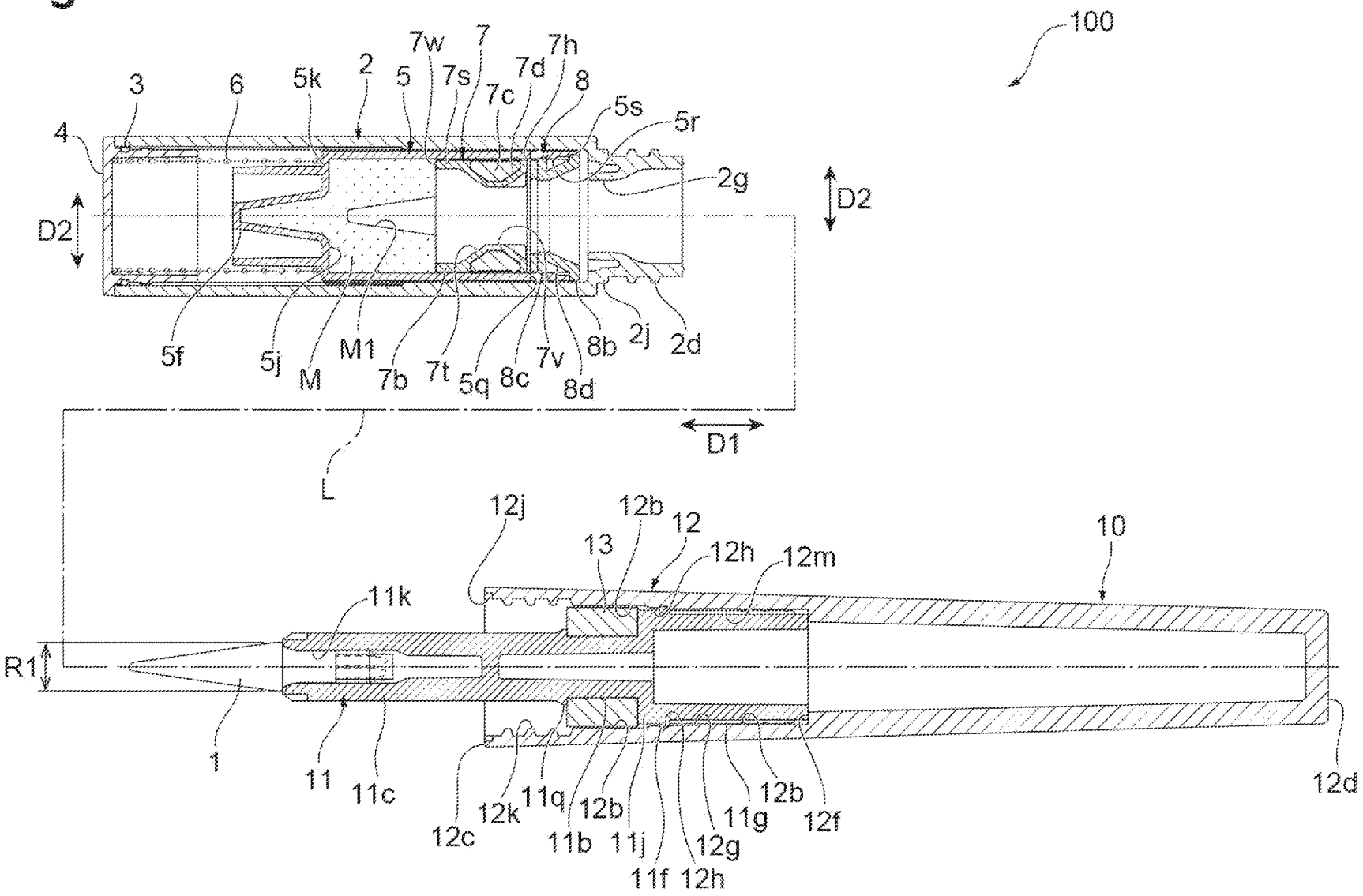
FIG. 4 is a cross-sectional view of the cosmetic container of FIG. 2 taken along line IV-IV.

FIG. 3A is a cross-sectional view of the cosmetic container 100 of FIG. 1 taken along line III-III. FIG. 3B is a cross-sectional view illustrating a state where an amount of the cosmetic M contained in the cosmetic container 100 of FIG. 3A has decreased. FIG. 4 is a cross-sectional view of the cosmetic container 100 of FIG. 2 taken along line IV-IV. With reference to FIGS. 3A, 3B and 4, the cosmetic container 100 has a substantially cylindrical shape extending in the axial direction D1. The cosmetic container 100 includes the cap 2 and the container main body 10 that holds the application body 1, in terms of exterior appearance.

The cap 2 is made of, for example, acrylonitrile butadiene styrene resin (ABS resin). The material of the cap 2 is not limited to the ABS resin and may be, for example, polypropylene resin (PP resin). The cap 2 is a tubular member to be detachably mounted on the container main body 10. A tail plug 4 is fitted into an end of the cap 2 in the axial direction D1 via an O-ring 3. The end of the cap 2 in the axial direction D1 is closed by the tail plug 4. The material of the O-ring 3 is, for example, NBR.

A filling member 5, a spring 6 (biasing device), a scraping member 7 having a tubular shape, and a stopper 8 are provided inside the cap 2. The filling member 5 functions as an inner reservoir filled with the cosmetic M. The spring 6 urges the filling member 5 toward the container main body 10 (application body 1). The scraping member 7 scrapes the cosmetic M inside the filling member 5. The stopper 8 functions as a member to prevent the scraping member 7 from being removed from the filling member 5. The tail plug 4, the spring 6, the filling member 5, and the stopper 8 are arranged in this order rearwardly from the front end, inside the cap 2. The scraping member 7 is movable in the axial direction D1 inside the filling member 5.

Figure 5:
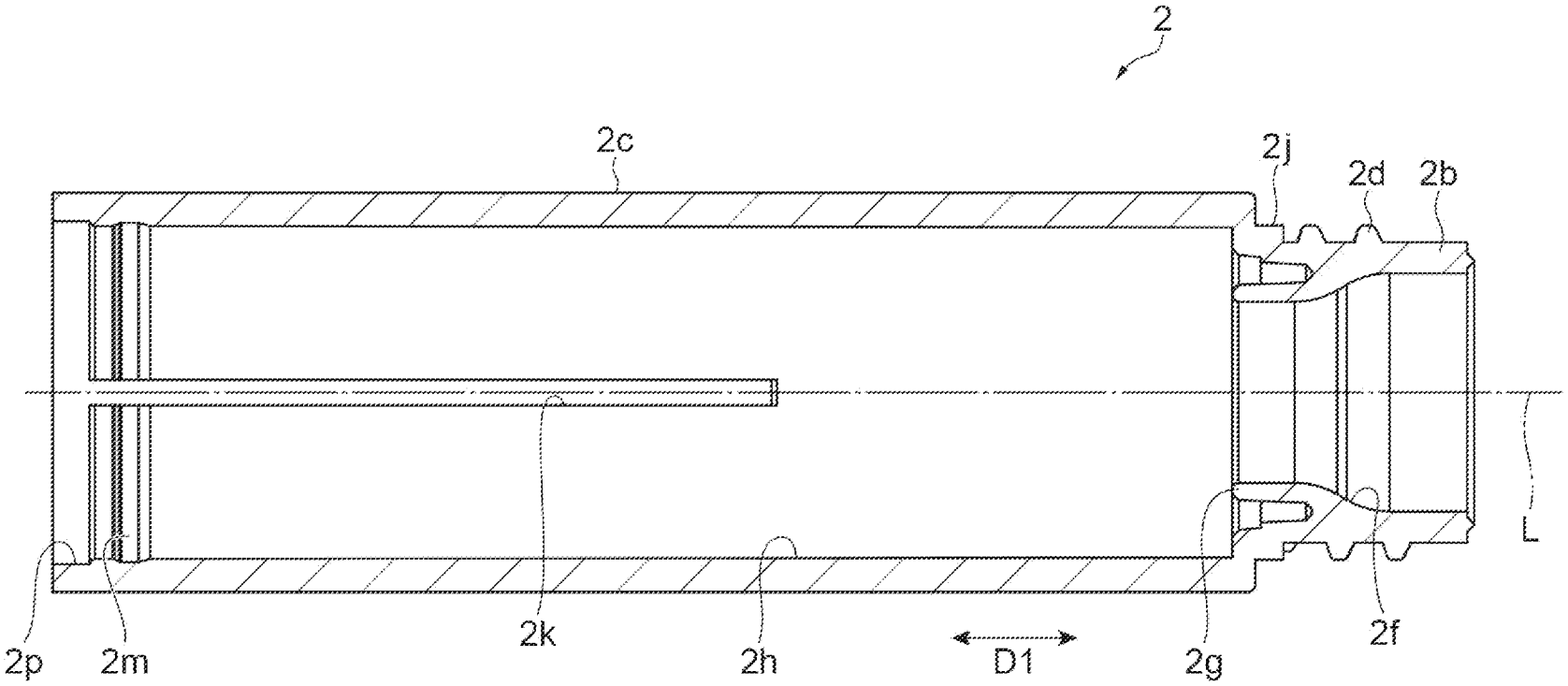
FIG. 5 is a cross-sectional view of the cap illustrated in FIG. 2.

FIG. 5 is an enlarged cross-sectional view of the cap 2. The cap 2 exhibits a stepped cylindrical shape. The cap 2 includes a reduced diameter portion 2*b* having a tubular shape that is located at an end opposite the tail plug 4 in the axial direction D1, and a tubular portion 2*c* extending from the reduced diameter portion 2*b* along the axial direction D1. The reduced diameter portion 2*b* forms an inserting portion to be inserted into the container main body 10. The reduced diameter portion 2*b* includes a male screw portion 2*d* to be screwed to the container main body 10, and a stepped portion 2*j* that is insertable into the container main body 10, that are formed on an outer periphery of the reduced diameter portion 2*b*.

An inclined surface 2*f* that is reduced in diameter toward the tubular portion 2*c*, and an annular protrusion portion 2*g* having a tubular shape and protruding from the inclined surface 2*f* toward the tubular portion 2*c* are formed in an inner peripheral surface of the reduced diameter portion 2*b*. The application body 1 may be inserted into the inside of the annular protrusion portion 2*g* along the axial direction D1. The annular protrusion portion 2*g* is, for example, a threshing portion that removes an excess of the cosmetic M adhering to the application body 1, when the application body 1 is pulled out along the axial direction D1.

An inner peripheral surface 2*h* of the tubular portion 2*c* is provided in on a front side of the annular protrusion portion 2*g* of the reduced diameter portion 2*b*. A recess 2*k* extending along the axial direction D1, an annular protrusion and recess portion 2*m* located toward a front end of the cap 2, and an annular recess portion 2*p* located in front of the annular protrusion and recess portion 2*m*, are formed in the inner peripheral surface 2*h* of the tubular portion 2*c*. The "annular protrusion and recess portion" refers to a portion in which a protrusion and a recess are arranged along the axial direction.

With reference to FIGS. 3A, 3B and 5, the recess 2*k* is a portion with which the filling member 5 engages in a rotation direction, to prevent a rotation of the filling member 5 with respect to the cap 2. The O-ring 3 abuts against the annular recess portion 2*p*, and the tail plug 4 engages with the annular protrusion and recess portion 2*m* in the axial direction D1. The stepped portion 2*j* enters the container main body 10 and the male screw portion 2*d* of the reduced diameter portion 2*b* is screwed to the container main body 10, so that the cap 2 is mounted on the container main body 10.

The tail plug 4 is made of, for example, acrylonitrile butadiene styrene (ABS) resin. The material of the tail plug 4 is not limited to the ABS resin, and may be, for example, polypropylene (PP) resin. The tail plug 4 includes a flange portion 4*b* forming an end portion of the cosmetic container 100 in the axial direction D1, and a tubular portion 4c having a bottomed cylindrical shape and protruding from the flange portion 4b in the axial direction D1. The tubular portion 4c is an inserting portion to be inserted into the cap 2. An annular protrusion 4d and an annular recess 4f are formed in an outer peripheral surface of the tubular portion 4c. The annular recess 4f is disposed between the flange portion 4b and the annular protrusion 4d in the axial direction D1.

The O-ring 3 enters the annular recess 4f, the O-ring 3 abuts against the annular recess portion 2p of the cap 2, and the annular protrusion 4d engages with the annular protrusion and recess portion 2m of the cap 2 in the axial direction D1, so that the tail plug 4 is mounted on the cap 2. The spring 6 that biases the filling member 5 in the axial direction D1 is interposed between a closed-end surface (or bottom surface) 4g of the tubular portion 4c of the tail plug 4 and the filling member 5. The material of the spring 6 is, for example, NBR.

Figure 6:
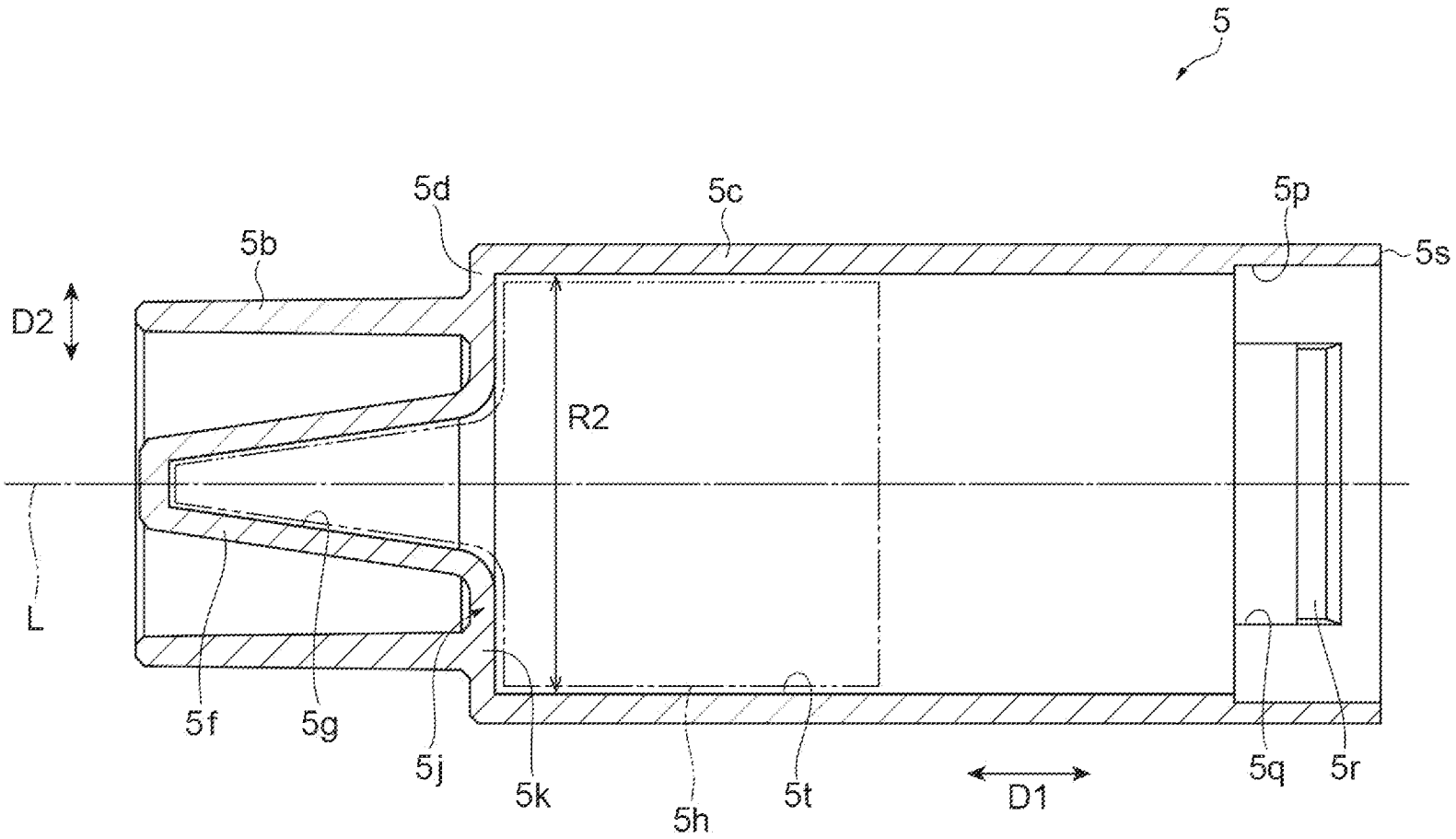
FIG. 6 is a cross-sectional view of a filling member of the cosmetic container of FIG. 1.
Figure 7:
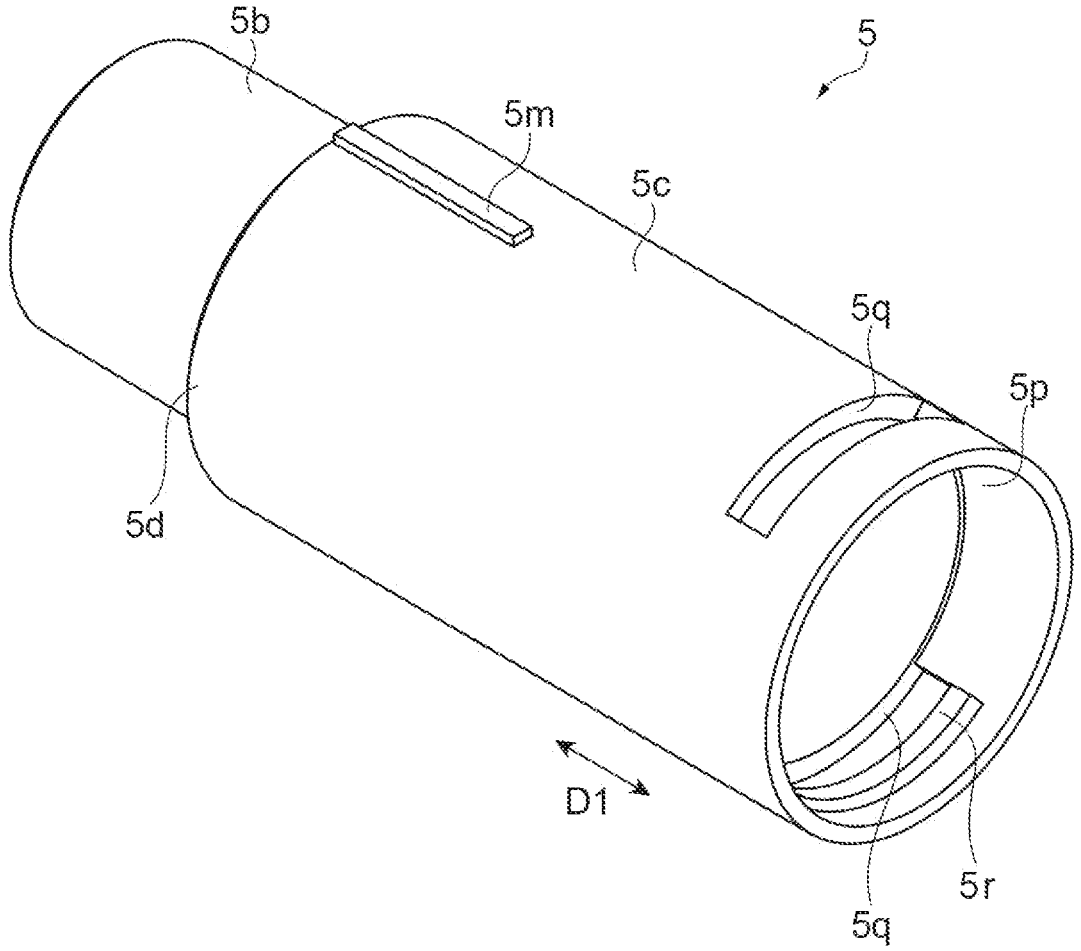
FIG. 7 is a perspective view of the filling member of FIG. 6.

FIG. 6 is an enlarged cross-sectional view of the filling member 5. FIG. 7 is a perspective view of the filling member 5. With reference to FIGS. 6 and 7, the filling member 5 has a bottomed tubular shape, and the filling member 5 is filled with the cosmetic M. The filling member 5 has a stepped cylindrical shape including a tubular portion 5b and a large diameter portion 5c that are arranged along the axial direction D1. The tubular portion 5b is connected to the large diameter portion 5c via a step 5d extending along a radial direction D2 of the filling member 5 and along a circumferential direction of the filling member 5.

The filling member 5 is made of, for example, PP resin. The tubular portion 5b has a cylindrical shape. A protrusion portion 5f having a tubular shape and protruding from the large diameter portion 5c along the axial direction D1 is formed inside the tubular portion 5b. The protrusion portion 5f has a truncated conical shape that decreases in diameter forwardly, namely the truncated conical shape is reduced in diameter as the truncated conical shape extends away from the large diameter portion 5c. The inside of the protrusion portion 5f is an insertion portion 5g into which the application body 1 may be inserted. The protrusion portion 5f has a shape conforming to an outer shape of the application body 1, and protrudes away from the container main body 10.

The insertion portion 5g and a front portion of the large diameter portion 5c, namely a portion on an insertion portion 5g side of the inside of the large diameter portion 5c, form a filling region 5h to be filled with the cosmetic M. The large diameter portion 5c has a bottomed cylindrical shape. The application body 1 is oriented toward a closed end (or bottom portion) 5j of the filling member 5 in the axial direction D1 when the application body 1 is inserted in the filling member 5. The bottom portion 5j is provided with an increased diameter portion 5k having a diameter R2 larger than a maximum diameter R1 of the application body 1 (cf. FIG. 4), and the insertion portion 5g is provided inside the increased diameter portion 5k in the radial direction D2. The increased diameter portion 5k refers to a portion of the bottom portion 5j where the diameter is increased to be greater than the maximum diameter R1 of the application body 1. Namely, the filling member 5 located inside the cap 2 forms the filling region 5h to contain the cosmetic, and the filling region 5h has a diameter R2 that is greater than a maximum diameter R1 of the application body 1.

A protrusion 5m extending from the step 5d in the axial direction D1 is formed on an outer peripheral surface of the large diameter portion 5c. An annular recess 5p is formed at an open end (or rear end) 5s of the large diameter portion 5c. A through-hole 5q penetrating through the filling member 5 and a protrusion 5r protruding to the inside of the filling member 5 in the radial direction D2 are formed in the annular recess 5p. The filling member 5 includes, for example, two through-holes 5q and two protrusions 5r. The two through-holes 5q and the two protrusions 5r each face each other along the radial direction D2 of the filling member 5.

With reference to FIGS. 3A, 3B, 6 and 7, the tubular portion 5b is inserted into the tubular portion 4c in a state where the spring 6 is interposed between the step 5d and the bottom surface 4g of the tubular portion 4c, and the protrusion 5m enters the recess 2k of the cap 2, so that the filling member 5 is mounted on the tail plug 4 and engages with the cap 2 in the rotation direction. The stopper 8 is inserted into the annular recess 5p of the open end 5s of the large diameter portion 5c and a part of the stopper 8 enters the through-holes 5q, so that the filling member 5 engages with the stopper 8.

The stopper 8 is made of, for example, PP resin. With reference to FIG. 4, the stopper 8 has a tubular shape including a first flange portion 8b located at a first end in the axial direction D1, a second flange portion 8c located at a second end opposite the first end in the axial direction D1, and an inclined portion 8d that is reduced in diameter from the first flange portion 8b toward the second flange portion 8c.

The first flange portion 8b abuts against the open end 5s of the filling member 5, the second flange portion 8c enters the through-holes 5q of the filling member 5, and the protrusions 5r of the filling member 5 are fitted to an outer side of the inclined portion 8d between the first flange portion 8b and the second flange portion 8c, so that the stopper 8 fixedly engages with the filling member 5. The stopper 8 engages with the filling member 5 in a state where the scraping member 7 is contained inside the filling member 5, to prevent the removal of the scraping member 7.

The scraping member 7 includes a slider 7b having a tubular shape that is movable in the axial direction D1 and is rotatable around the axis L of the cosmetic container 100 inside the filling member 5, and an elastic portion 7c interposed between the slider 7b and an inner surface 5t of the filling member 5. The elastic portion 7c is in close contact with an outer surface of the slider 7b and with the inner surface 5t of the filling member 5, to prevent leakage of the cosmetic M with which the filling member 5 is filled.

Figure 8:
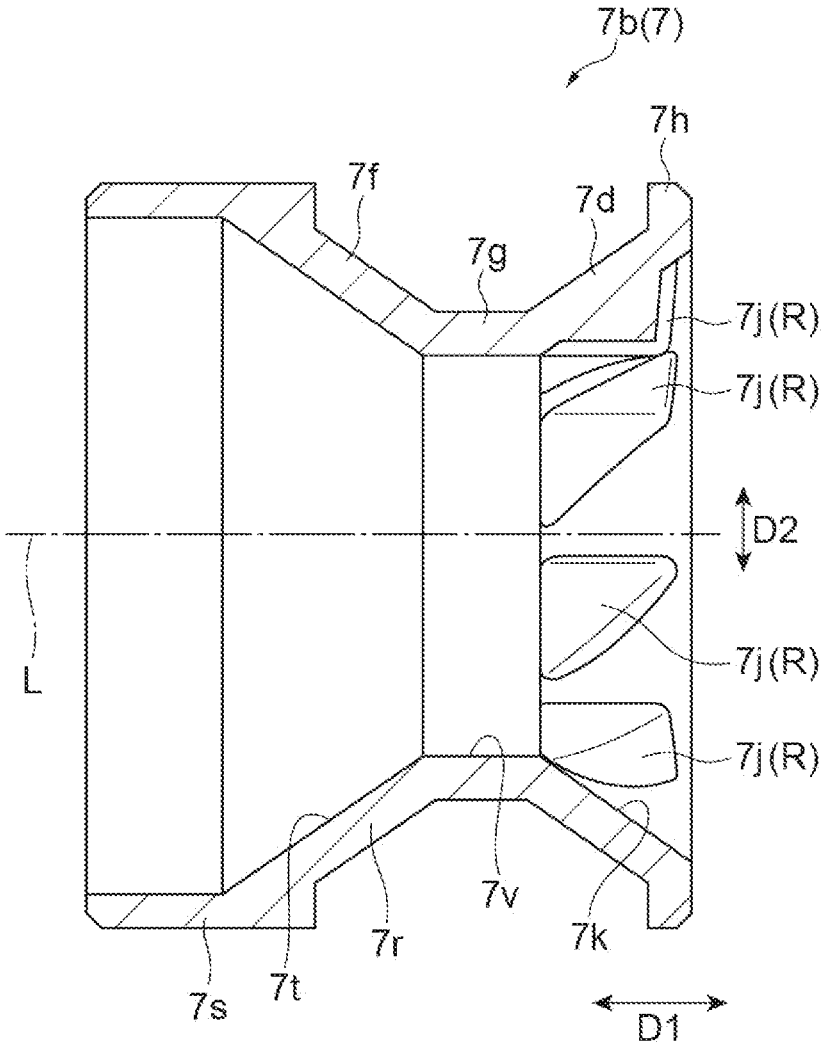
FIG. 8 is a cross-sectional view of a scraping member of the cosmetic container of FIG. 1.
Figure 9:
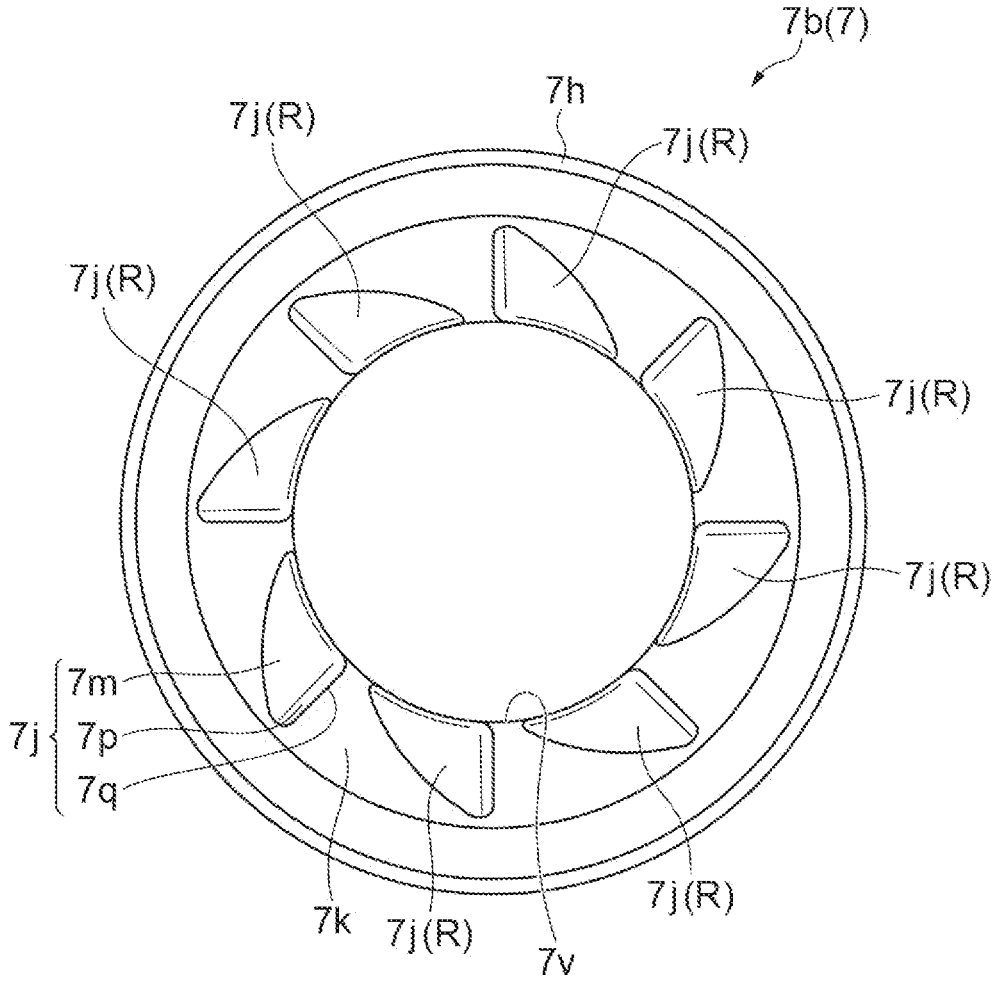
FIG. 9 is a rear view of the scraping member of FIG. 8.

FIG. 8 is a cross-sectional view illustrating the slider 7b. FIG. 9 is a rear view of the slider 7b when viewed from the rear side in the axial direction D1. With reference to FIGS. 8 and 9, the slider 7b includes a first increased diameter portion 7d that is gradually increased in diameter in the rearward direction of the axial direction D1, a second increased diameter portion 7f that is gradually increased in diameter in the forward direction of the axial direction D1, and a connecting tubular portion 7g that connects the first increased diameter portion 7d and the second increased diameter portion 7f to each other.

The slider 7b is made of, for example, stainless steel (SUS). A rear end of the first increased diameter portion 7d of the slider 7b in the axial direction D1 is provided with a protrusion portion 7h protruding to the outside of the scraping member 7 in the radial direction D2. The protrusion portion 7h is a portion that slides on the inner surface 5t of the filling member 5. An inner surface of the connecting tubular portion 7g forms a tubular hole 7v of the scraping member 7 into which the application body 1 is inserted along the axial direction D1. Accordingly, the scraping member 7 forms the tubular hole 7v in order to insert the application body 1 into the filling region 5*h* of the filling member 5. According to examples, the scraping member 7 extends at least partially into the filling member 5 to scrape the cosmetic M stored in the filling region 5*h*.

Ratchet teeth 7*j* (second ratchet teeth) are formed in an inner surface 7*k* of the first increased diameter portion 7*d*. A shaft portion 11 of the container main body 10 which is described further below, engages the ratchet teeth 7*j*. The scraping member 7 includes a plurality of the ratchet teeth 7*j*. Each of the ratchet teeth 7*j* has an inclined surface 7*m* that protrudes obliquely from the inner surface 7*k*, and an abutting surface 7*q* extending substantially perpendicularly to the inner surface 7*k* from a top 7*p* of the inclined surface 7*m*. The scraping member 7 includes, for example, eight ratchet teeth 7*j*. For example, the eight ratchet teeth 7*j* may be disposed at equal intervals along a circumferential direction of the scraping member 7.

The second increased diameter portion 7*f* includes an inclined portion 7*r* that increases in diameter from the connecting tubular portion 7*g*, and a tubular portion 7*s* located on an opposite side of the inclined portion 7*r* to the connecting tubular portion 7*g*. An outer surface of the tubular portion 7*s* is a portion that slides on the inner surface 5*t* of the filling member 5. An inner surface of the inclined portion 7*r* is an inclined surface 7*t* that is reduced in diameter rearwardly, namely as the inclined portion 7*r* extends from the tubular portion 7*s* toward the connecting tubular portion 7*g*. Namely, with respect to the filling member 5 forming the open end 5*s* to insert the application body 1 and the closed end 5*j* opposite the open end 5*s*, the inner surface of the scraping member 7 that forms the tubular hole 7*v*, includes the inclined surface 7*t* which extends radially outwardly toward the closed end 5*j* of the filling member 5 (cf. FIG. 6).

With reference to FIG. 4, the elastic portion 7*c* is a leakage prevention member having a tubular shape that is in close contact with the outer surface of the slider 7*b* and with the inner surface 5*t* of the filling member 5 to suppress leakage of the cosmetic M to the outside of the filling member 5. The elastic portion 7*c* is separate from the slider 7*b*. The elastic portion 7*c* is made of, for example, NBR. The elastic portion 7*c* is interposed between the protrusion portion 7*h* of the first increased diameter portion 7*d* of the slider 7*b* and the tubular portion 7*s*. An outer surface of the elastic portion 7*c* slides against the inner surface 5*t* of the filling member 5.

In a state where the scraping member 7 is contained inside the filling member 5, the inclined surface 7*t* of the scraping member 7 is inclined radially inwardly and rearwardly, namely to the inside of the scraping member 7 in the radial direction D2 as the inclined surface 7*t* extends away from the bottom portion 5*j* of the filling member 5. The tubular hole 7*v* is located on a rear side of the inclined surface 7*t*, and the application body 1 held by the container main body 10 is inserted into the tubular hole 7*v* toward the cosmetic M in the axial direction D1.

The container main body 10 includes the shaft portion 11 that holds the application body 1 and that extends along the axial direction D1, the sleeve 12 having a bottomed tubular shape that holds the shaft portion 11 and that is mounted on the cap 2, and a bushing 13 interposed between an outer surface 11*b* of the shaft portion 11 and an inner surface 12*b* of the sleeve 12. The bushing 13 is in close contact with the outer surface 11*b* of the shaft portion 11 and with the inner surface 12*b* of the sleeve 12 to suppress the entry of the cosmetic M into the inside of the sleeve 12. The bushing 13 is made of, for example, NBR.

The sleeve 12 is made of, for example, PP resin. The sleeve 12 is gradually reduced in diameter rearwardly, namely as the sleeve 12 extends from a front end 12*c* toward a rear end 12*d* in the axial direction D1. A stepped portion 12*f* formed on the inner surface 12*b* of the sleeve 12, is recessed outwardly in the radial direction D2, to provide an increased diameter hole portion 12*g* extending from the stepped portion 12*f* toward the front end 12*c* at a front end portion of the sleeve 12. An annular protrusion and recess portion 12*h* with which the shaft portion 11 engages in the axial direction D1, and a recess 12*j* and a female screw portion 12*k* located at the front end 12*c* of the sleeve 12 are formed in the increased diameter hole portion 12*g*.

The shaft portion 11 engages with the annular protrusion and recess portion 12*h* in the axial direction D1, so that the shaft portion 11 is mounted on the sleeve 12. The stepped portion 2*j* of the cap 2 enters the recess 12*j* in the axial direction D1 and the male screw portion 2*d* of the cap 2 is screwed to the female screw portion 12*k*, so that the cap 2 is mounted to the sleeve 12.

Figure 10:
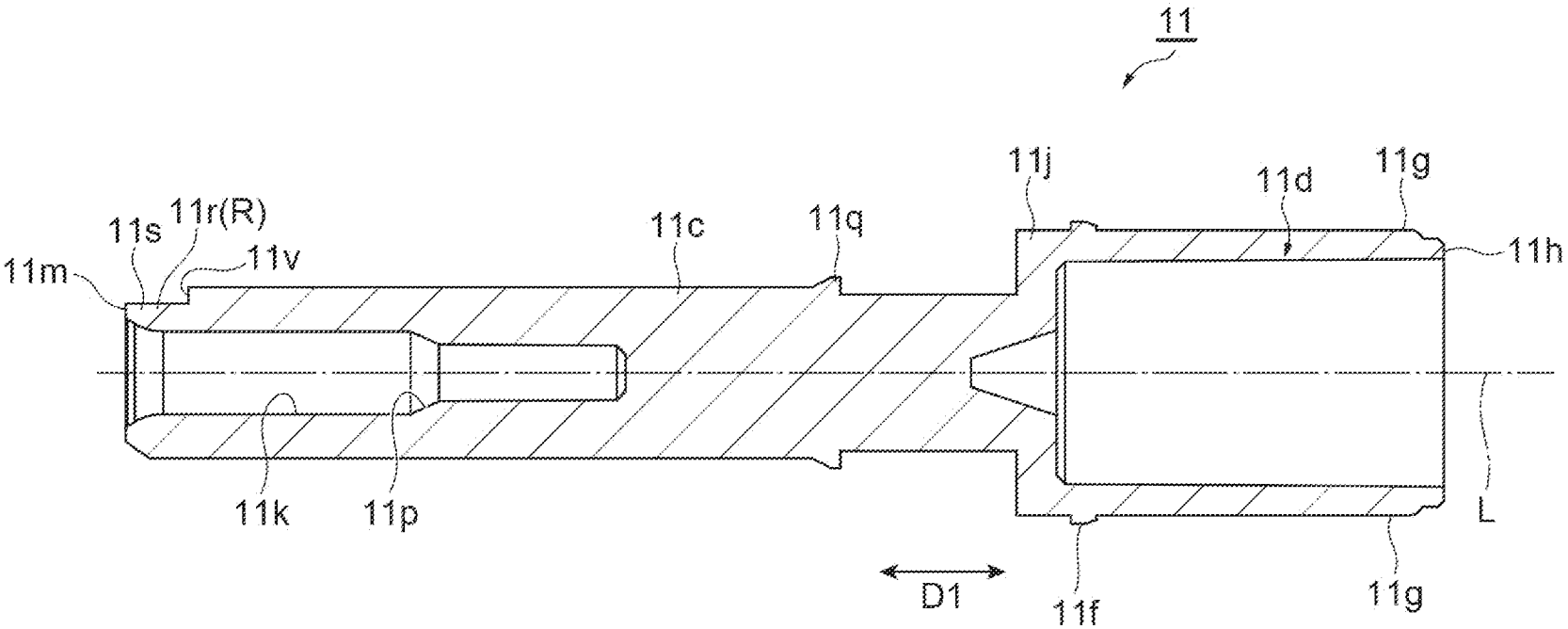
FIG. 10 is a cross-sectional view of a shaft portion of the container main body of FIG. 2.
Figure 11:
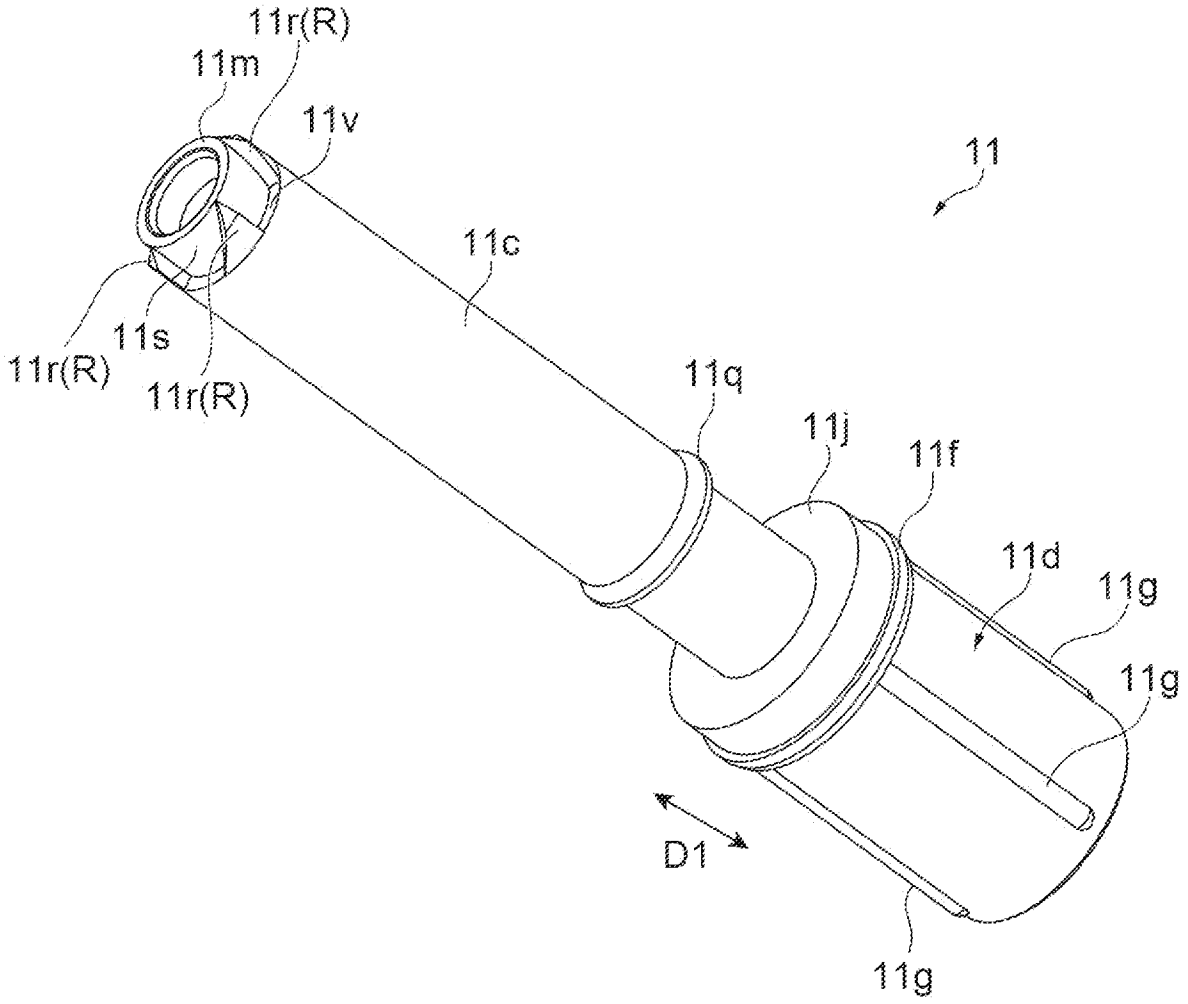
FIG. 11 is a perspective view of the shaft portion of FIG. 10.

FIG. 10 is an enlarged cross-sectional view of the shaft portion 11. FIG. 11 is a perspective view illustrating the shaft portion 11. With reference to FIGS. 10 and 11, the shaft portion 11 has a stepped cylindrical shape including a reduced diameter portion 11*c* at a front portion in the axial direction D1 and including an increased diameter portion 11*d* at a rear portion in the axial direction D1. The shaft portion 11 is made of, for example, ABS resin.

The increased diameter portion 11*d* has a bottomed cylindrical shape. An annular protrusion 11*f* and a projection 11*g* are formed on an outer surface of the increased diameter portion 11*d*. The increased diameter portion 11*d* includes a plurality of the projections 11*g*. Each of the projections 11*g* extends from the annular protrusion 11*f* toward a rear end 11*h* of the shaft portion 11 in the axial direction D1. The increased diameter portion 11*d* includes, for example, four projections 11*g*. The four projections 11*g* are disposed at equal intervals along a circumferential direction of the shaft portion 11.

A stepped portion 11*j* protruding from the reduced diameter portion 11*c* toward the increased diameter portion 11*d*, is formed between the reduced diameter portion 11*c* and the increased diameter portion 11*d*. The reduced diameter portion 11*c* has a bottomed cylindrical shape. A hole portion 11*k* extending in the axial direction D1 is formed inside the reduced diameter portion 11*c*. The hole portion 11*k* includes a reduced diameter portion 11*p* that is reduced in diameter rearwardly, namely as the reduced diameter portion 11*p* extends away from a front end 11*m* of the shaft portion 11.

An annular protrusion 11*q*, and ratchet teeth 11*r* (first ratchet teeth) located at the front end 11*m* of the shaft portion 11 are formed in an outer surface of the reduced diameter portion 11*c*. The ratchet teeth 11*r* form a ratchet mechanism R, together with the ratchet teeth 7*j* of the scraping member 7 described above. A small diameter portion 11*s* that is further reduced in diameter relative to the reduced diameter portion 11*c*, is formed at the front end 11*m* of the shaft portion 11. The ratchet teeth 11*r* are formed in the small diameter portion 11*s*. A stepped surface 11*v* extending radially with respect to the axial direction D1 is provided between the small diameter portion 11*s* and the reduced diameter portion 11*c*.

Figure 12:
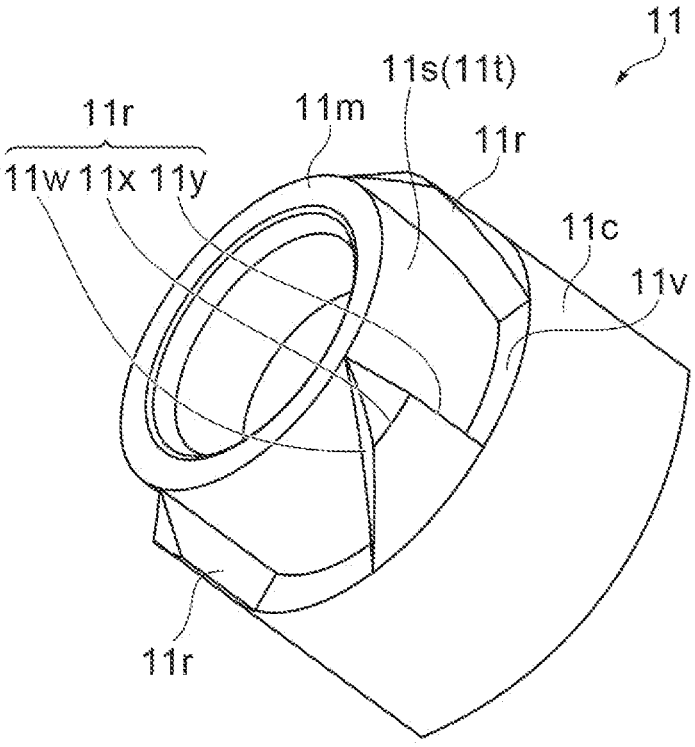
FIG. 12 is an enlarged partial perspective view of the shaft portion of FIG. 11, illustrating ratchet teeth.

FIG. 12 is an enlarged perspective view of a periphery of the ratchet teeth 11*r* of the shaft portion 11. With reference to FIG. 12, the shaft portion 11 includes a plurality of the ratchet teeth 11*r* on an outer surface 11*t* of the small diameter portion 11*s* and on the stepped surface 11*v*. Each of the ratchet teeth 11*r* has an inclined surface 11*w* that protrudes obliquely from the stepped surface 11*v*, and an abutting surface 11*y* that extends substantially perpendicularly from a top 11*x* of the inclined surface 11*w* toward the stepped surface 11*v*. For example, the plurality of ratchet teeth 11*r* are disposed at equal intervals along the circumferential direction of the shaft portion 11.

With reference to FIG. 4, the projections 11*g* enter recesses 12*m* formed in the inner surface 12*b* of the sleeve 12, to cause the shaft portion 11 to engage with the sleeve 12 in the rotation direction, and the annular protrusion 11*f* engages with the annular protrusion and recess portion 12*h* of the sleeve 12 in the axial direction D1, so that the shaft portion 11 is mounted on the sleeve 12.

The bushing 13 is interposed between the stepped portion 11*j* of the shaft portion 11 and the annular protrusion 11*q*, and in this state, the bushing 13 is in close contact with the inner surface 12*b* of the sleeve 12. The application body 1 is pushed into the hole portion 11*k* of the reduced diameter portion 11*c* in the axial direction D1, so that the application body 1 is mounted on the shaft portion 11.

A method of using the above-described application body 1 will be described. In an initial state illustrated in FIG. 3A, the application body 1 held by the container main body 10 is inserted into the cosmetic M with which the filling member 5 is filled. For example, an application body insertion hole M1 is formed in the cosmetic M, and a shape of an inner surface of the application body insertion hole M1 is a shape conforming to an outer surface of the application body 1. The sleeve 12 may be rotated relative to the cap 2 in a first direction or an unscrewing direction (for example, counterclockwise), in a state where the application body 1 is inserted into the application body insertion hole M1, to unscrew the male screw portion 2*d* from the female screw portion 12*k*, so that the sleeve 12 is removed from the cap 2.

When the sleeve 12 rotates relative to the cap 2 in the unscrewing direction, the sleeve 12, the bushing 13, and the shaft portion 11 integrally rotate in the unscrewing direction. Then, the ratchet teeth 11*r* of the shaft portion 11 that form the ratchet mechanism R repeatedly engage with and disengage from (mesh with and unmesh from) the ratchet teeth 7*j* of the scraping member 7. In the present disclosure, "meshing" includes not only a state where two teeth mesh with each other, but also a state where a protruding portion of a first component abuts against or contacts a protruding portion of a second component.

Namely, when the ratchet teeth 11*r* and the ratchet teeth 7*j* rotate relative to each other in the unscrewing direction in a state where the ratchet teeth 11*r* and the ratchet teeth 7*j* engage with each other in the rotation direction, the inclined surfaces 11*w* of the ratchet teeth 11*r* abut against the inclined surfaces 7*m* of the ratchet teeth 7*j*, and in this state, the inclined surfaces 11*w* slide against the inclined surfaces 7*m* to run up the inclined surfaces 7*m*. Then, after the inclined surfaces 11*w* climb over the inclined surfaces 7*m*, the ratchet teeth 11*r* and the ratchet teeth 7*j* engage with each other in the rotation direction again. When the ratchet teeth 11*r* and the ratchet teeth 7*j* repeat engagement and disengagement in such a manner, a clicking feeling or effect is provided to a user, and the scraping member 7 vibrates and scrapes the cosmetic M.

When the sleeve 12 is removed from the cap 2 and the application body 1 is pulled out from the cosmetic M, a part of the cosmetic M moves to an inner surface of the scraping member 7, together with the application body 1. At this time, the cosmetic M that moves together with the application body 1 is guided inwardly in the radial direction D2 via the inclined surface 7*t* of the scraping member 7, and is drawn toward an application body 1 so as to adhere to the application body 1. Namely, the cosmetic M located radially away from the application body 1, namely the cosmetic M located outside the application body 1 in the radial direction D2, is guided inwardly in the radial direction D2 by the inclined surface 7*t* to adhere to the outer surface of the application body 1.

With reference to FIGS. 3A, 3B and 4, when the application body 1 to which the cosmetic M adheres is pulled out from the scraping member 7, the application body 1 reaches the annular protrusion portion 2*g* of the cap 2 through an inner surface of the stopper 8, and an excess of the cosmetic M that adheres to the application body 1 is removed by the annular protrusion portion 2*g*. Subsequently, the application body 1 to which the cosmetic M is adhered in a moderate quantity is pulled out from the cap 2, and is ready for application by a user.

After application by the application body 1 is completed, the application body 1 is inserted back into the cap 2. At this time, the application body 1 passes through an inner surface of the cap 2, through the inner surface of the stopper 8, and through the tubular hole 7*v* of the scraping member 7 to reach the cosmetic M with which the filling member 5 is filled, and the application body 1 is inserted into the application body insertion hole M1. Then, the female screw portion 12*k* of the sleeve 12 reaches the male screw portion 2*d* of the cap 2. When the sleeve 12 is rotated relative to the cap 2 in a second direction or a screwing direction (for example, clockwise) that is opposite to the unscrewing direction described above, the female screw portion 12*k* is screwed to the male screw portion 2*d*, so that the sleeve 12 is mounted to the cap 2.

When the sleeve 12 is rotated relative to the cap 2 in the screwing direction or second direction, the sleeve 12, the bushing 13, and the shaft portion 11 integrally rotate in the second direction. Then, the ratchet teeth 11*r* of the shaft portion 11 and the ratchet teeth 7*j* of the scraping member 7 that form the ratchet mechanism R engage with each other in the rotation direction, and the scraping member 7 synchronously rotates in the second direction.

Namely, when relative rotation in the second direction is performed, the abutting surfaces 11*y* of the ratchet teeth 11*r* abut against the abutting surfaces 7*q* of the ratchet teeth 7*j* in the rotation direction, and relative rotation of the scraping member 7 with respect to the shaft portion 11 is restricted, and the scraping member 7 rotates synchronously with the shaft portion 11. Therefore, when the sleeve 12 rotates relative to the cap 2 in the second direction, the scraping member 7 rotates relative to the filling member 5 in the second direction, together with the sleeve 12 and the shaft portion 11. When the scraping member 7 rotates relative to the filling member 5, the scraping member 7 pushes the cosmetic M inside the filling member 5, and scoops and scrapes the cosmetic M.

For example, the scraping member 7 may rotate while a front end 7*w* of the tubular portion 7*s* of the scraping member 7 is pressed against the cosmetic M, so as to scoop the cosmetic M located radially away from the application body 1, namely the cosmetic M located outside the application body 1 in the radial direction D2, in order to scrape the cosmetic M in the filling region 5*h* of filling member 5. When the application body 1 is pulled out from the cosmetic M the next time, the scraped cosmetic M is guided to the inclined surface 7*t* of the scraping member 7 to adhere to the application body 1.

Therefore, the cosmetic M located radially away from the application body 1 (e.g., outside the application body 1 in the radial direction D2) is scooped and guided to the application body 1, so that the cosmetic M located on the increased diameter portion 5*k* also more reliably adheres to the application body 1 in order to be applied. When the amount of the cosmetic M with which the filling member 5 is filled is reduced, the filling member 5 is pushed rearwardly (away from the tail plug 4) by a biasing force of the spring 6, and the stopper 8 approaches the annular protrusion portion 2*g* of the cap 2.

As described above, in the example cosmetic container 100, the scraping member 7 having a tubular shape may scrape the cosmetic M with which the filling member 5 is filled, so that the cosmetic M scraped by the scraping member 7 adheres to the application body 1. The filling member 5 includes the bottom portion (or closed end) 5*j* that the application body 1 is oriented toward (or faces) in the axial direction D1, and the bottom portion 5*j* is provided with the increased diameter portion 5*k* having the diameter R2 (cf. FIG. 6) larger than the maximum diameter R1 of the application body 1. Consequently, the filling member 5 includes the increased diameter portion 5*k* having a diameter larger than the maximum diameter R1 of the application body 1, so that the amount of the cosmetic M to be filled can be increased.

Since the amount of the cosmetic M can be increased without increasing a length of the filling member 5 in the axial direction D1, the cosmetic container 100 is more convenient to carry and provides increased portability. The scraping member 7 is provided inside the filling member 5. The scraping member 7 has the tubular hole 7*v* into which the application body 1 is inserted toward the cosmetic M. Therefore, the scraping member 7 scrapes the cosmetic M inside the filling member 5, so that the cosmetic M scraped by the scraping member 7 can be more easily guided to the application body 1 inserted into the tubular hole 7*v* of the scraping member 7. Consequently, a greater quantity of the cosmetic M may adhere to the application body 1, so that the residual amount of the filled cosmetic M can be reduced.

The inclined surface 7*t* that is inclined radially inwardly and rearwardly, namely inclined inwardly in the radial direction D2 as the inclined surface 7*t* extends away from the bottom portion 5*j* of the filling member 5 is formed on an inner side of the scraping member 7 having a tubular shape. The inclined surface 7*t* is inclined from an outer edge portion of the scraping member 7 in the radial direction D2 toward the application body 1 inserted into the tubular hole 7*v*. Consequently, when the application body 1 is pulled out from the cosmetic M and from the scraping member 7 and is used, the cosmetic M is guided toward the application body 1 along the inclined surface 7*t*. Therefore, the scraped cosmetic M can be guided to the application body 1 along the inclined surface 7*t* while the filled cosmetic M is scraped by the scraping member 7, so that a greater quantity of the cosmetic M may adhere to the application body 1. Since a greater quantity of the cosmetic M with which the filling member 5 is filled may adhere to the application body 1, the residual amount of the filled cosmetic M may be better reduced.

The scraping member 7 is movable in the axial direction D1 and is rotatable in the circumferential direction of the filling member 5 with respect to the filling member 5. Since the scraping member 7 is movable in the axial direction D1 and is rotatable in the circumferential direction with respect to the filling member 5 to scoop the filled cosmetic M, the cosmetic M can be more efficiently scraped. Therefore, a greater quantity of the cosmetic M may adhere to the application body 1, so as to reduce the residual amount of the filled cosmetic M.

The container main body 10 includes the shaft portion 11 that holds the application body 1 and that extends from the application body 1 in the axial direction D1, and the shaft portion 11 includes the ratchet teeth 11*r*. The scraping member 7 includes the ratchet teeth 7*j* with which the ratchet teeth 11*r* mesh. The ratchet teeth 11*r* and the ratchet teeth 7*j* form the ratchet mechanism R that allows relative rotation between the shaft portion 11 and the scraping member 7 in the first direction and that restricts relative rotation therebetween in the second direction that is opposite the first direction. The scraping member 7 is restricted from rotating relative to the shaft portion 11 by the ratchet mechanism R, and rotates synchronously with the shaft portion 11 to scrape the cosmetic M.

Therefore, the ratchet teeth 11*r* provided in the shaft portion 11 that holds the application body 1 and the ratchet teeth 7*j* provided in the scraping member 7 form the ratchet mechanism R that allows relative rotation between the shaft portion 11 and the scraping member 7 in the first direction. Since the ratchet mechanism R allows relative rotation between the shaft portion 11 and the scraping member 7 in the first direction and restricts relative rotation between the shaft portion 11 and the scraping member 7 in the second direction, the shaft portion 11 and the scraping member 7 rotate synchronously in the second direction. Since the synchronous rotation allows the scraping member 7 to scoop the cosmetic M, the cosmetic M can be scraped with the rotation of the shaft portion 11, so that a greater quantity of the cosmetic M may adhere to the application body 1.

The scraping member 7 includes the elastic portion 7*c* that is in contact with the inner surface 5*t* of the filling member 5. Since the scraping member 7 includes the elastic portion 7*c* that is in contact with the inner surface 5*t* of the filling member 5, a gap formed between the scraping member 7 and the inner surface 5*t* of the filling member 5 can be blocked by the elastic portion 7*c*, so that leakage of the cosmetic M can be reliably suppressed.

The cosmetic container 100 includes the spring 6 that biases the filling member 5 toward the container main body 10 inside the cap 2. By the way, a cosmetic container is known in which the container main body 10 that holds the application body 1 includes a biasing device for biasing the application body 1 to a filling member 5 side. However, in the cosmetic container, since the application body 1 is biased by the biasing device, when application is performed, the application body 1 may move and become unstable, and it may be more difficult to perform application of the cosmetic M. In the example cosmetic container 100, when the spring 6 that biases the filling member 5 is provided inside the cap 2, there is no need to provide the biasing device in the application body 1, so that the application body 1 can be fixed to the container main body 10. Therefore, the application body 1 can be stabilized, so that application can be performed with more ease.

The bottom portion 5*j* of the filling member 5 includes the protrusion portion 5*f* having a shape along the outer shape of the application body 1 and protruding away from the container main body 10. Consequently, the protrusion portion 5*f* provided in the bottom portion 5*j* of the filling member 5 has a shape along the outer shape of the application body 1. Therefore, the application body 1 is inserted into a portion inside the protrusion portion 5*f*, so that a greater quantity of the cosmetic M inside the filling member 5 may adhere to the application body 1 and deformation of the application body 1 caused by the insertion of the application body 1 into the inside of the protrusion portion 5*f* can be suppressed.

Figure 13:
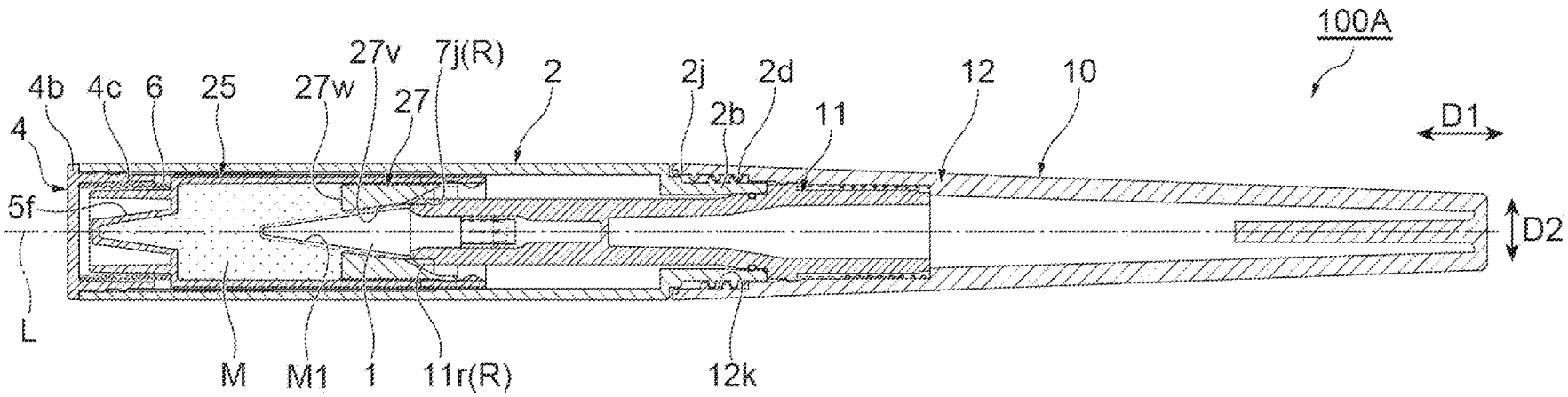
FIG. 13 is a cross-sectional view of a cosmetic container according to a modified example.

Cosmetic containers according to other examples will be described. FIG. 13 is a cross-sectional view illustrating a cosmetic container 100A according to a modified example, taken along line III-III similarly to FIG. 3A. Some of cosmetic containers according to the following examples have similar configurations as those of some of the cosmetic container 100 described above. Consequently, in the following description, description that overlaps the above-described example may be omitted.

With reference to FIG. 13, the cosmetic container 100A does not include the above-described stopper 8. In addition, the container main body 10 of the cosmetic container 100A does not include the bushing 13. The cosmetic container 100A includes a filling member 25 that does not include the annular recess 5*p* and the through-holes 5*q*, instead of the filling member 5. The cosmetic container 100A includes a scraping member 27 that is different from the scraping member 7 described above, and the scraping member 27 does not include the elastic portion 7*c* described above.

The scraping member 27 functions as a slider that is movable in the axial direction D1 with respect to the filling member 25. The scraping member 27 is rotatable in a circumferential direction of the filling member 25 with respect to the filling member 25. The scraping member 27 has a tubular shape having a tubular hole 27*v* into which the application body 1 is inserted, and an outer peripheral surface of the scraping member 27 slides against an inner surface of the filling member 25. The tubular hole 27*v* has a shape conforming to the outer surface of the application body 1. An inner diameter of the tubular hole 27*v* is increased as the tubular hole 27*v* extends rearwardly, namely away from the cosmetic M. The scraping member 27 has an end surface 27*w* that is in contact with the cosmetic M. For example, the end surface 27*w* extends orthogonally to the axial direction D1.

As described above, in the cosmetic container 100A, the scraping member 27 has the tubular hole 27*v* into which the application body 1 is inserted toward the cosmetic M, and the scraping member 27 scrapes the cosmetic M inside the filling member 25. Therefore, similarly to the above-described example, the cosmetic M scraped by the scraping member 27 can be more easily guided to the application body 1 inserted into the tubular hole 27*v* of the scraping member 27, so that the residual amount of the filled cosmetic M can be reduced. Further, in the cosmetic container 100A, the cosmetic M presses the scraping member 27, together with the filling member 25, by virtue of the biasing force of the spring 6. Accordingly, a greater quantity of the cosmetic M may adhere to the application body 1.

Figure 14:
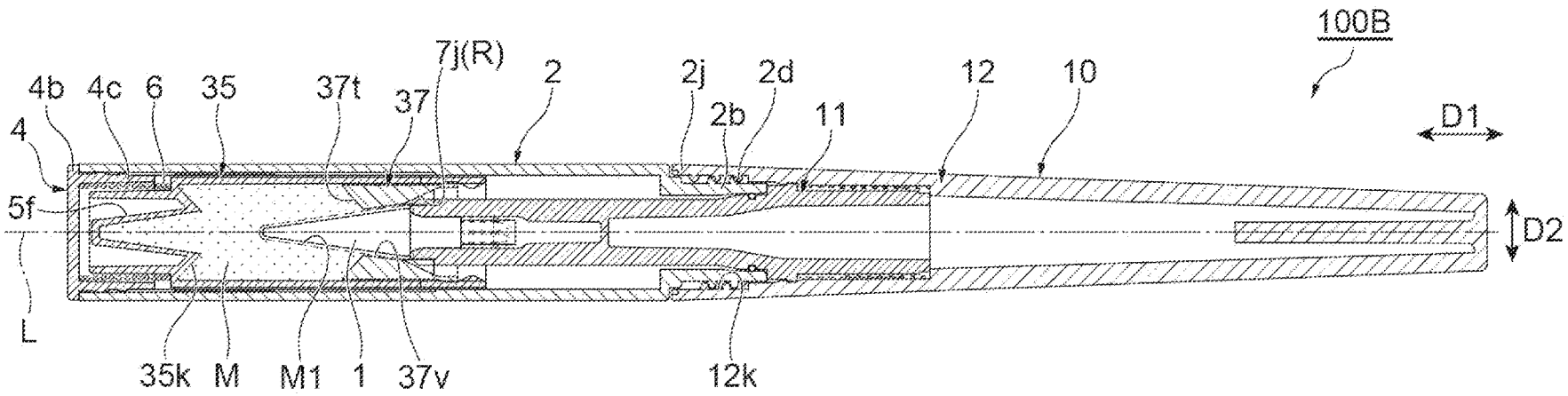
FIG. 14 is a cross-sectional view of a cosmetic container according to another modified example.

FIG. 14 is a cross-sectional view illustrating a cosmetic container 100B according to another example, taken along line III-III (cf. FIG. 1). With reference to FIG. 14, the cosmetic container 100B includes a filling member 35 and a scraping member 37 that are different from the filling member 25 and the scraping member 27 of the cosmetic container 100A, respectively. An increased diameter portion 35*k* having a diameter larger than the maximum diameter of the application body 1 is formed in a front portion (or bottom portion) of the filling member 35. The increased diameter portion 35*k* is inclined radially outwardly and forwardly, namely to be inclined away from the application body 1 (toward a tail plug 4 side) as the increased diameter portion 35*k* extends outwardly in the radial direction D2. Namely, the increased diameter portion 35*k* is inclined inwardly and rearwardly, namely to the inside of the filling member 35 in the radial direction D2 as the increased diameter portion 35*k* extends away from the tail plug 4.

The scraping member 37 has a tubular shape having a tubular hole 37*v* into which the application body 1 is inserted, and has an inclined surface 37*t* that is in contact with the cosmetic M. The inclined surface 37*t* is inclined inwardly and rearwardly, namely inclined to the inside of the scraping member 37 in the radial direction D2 as the inclined surface 37*t* extends away from the front portion of the filling member 35. For example, the inclined surface 37*t* extends along the increased diameter portion 35*k* of the filling member 35, and may extend parallel to the increased diameter portion 35*k*. In this case, since the cosmetic M presses the scraping member 37, together with the filling member 35, by virtue of the biasing force of the spring 6, the efficiency of the adhesion of the cosmetic M to the application body 1 can be increased, so that the cosmetic M can be more reliably dispensed.

As described above, in the cosmetic container 100B, the inclined surface 37*t* is formed in the scraping member 37 having a tubular shape. Since the inclined surface 37*t* is inclined toward the application body 1 inserted into the tubular hole 37*v*, when the application body 1 is pulled out from the cosmetic M and from the scraping member 37 and is used, the cosmetic M can be guided along the inclined surface 37*t*. Therefore, similarly to the above-described cosmetic container 100A, a greater quantity of the cosmetic M may adhere to the application body 1, so that the residual amount of the cosmetic M of the filling member 35 can be more reliably reduced.

Figure 15:
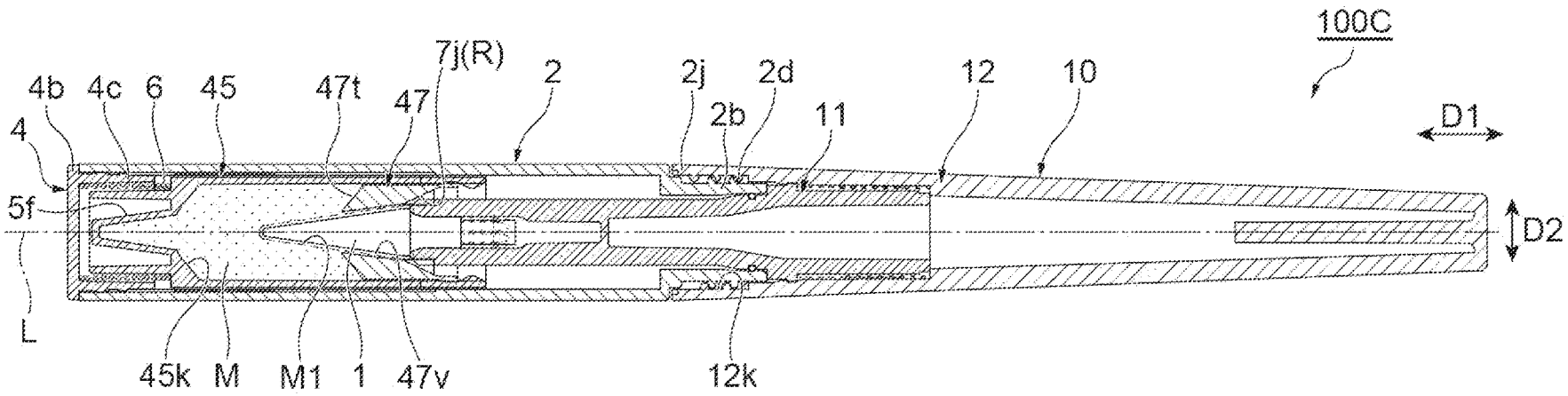
FIG. 15 is a cross-sectional view of a cosmetic container according to a further modified example.

FIG. 15 is a cross-sectional view illustrating a cosmetic container 100C according to another example, taken along line III-III (cf. FIG. 1). With reference to FIG. 15, the cosmetic container 100C includes a filling member 45 and a scraping member 47 that are different from the filling member 35 and the scraping member 37, respectively, of the cosmetic container 100B. An increased diameter portion 45*k* is formed in a front portion (or bottom portion) of the filling member 45. The increased diameter portion 45*k* is inclined radially outwardly and rearwardly, namely inclined toward the application body 1 (container main body 10 side) as the increased diameter portion 45*k* extends outwardly in the radial direction D2. The increased diameter portion 45*k* is increased in thickness in the axial direction D1, as the increased diameter portion 45*k* extends outwardly in the radial direction D2.

The scraping member 47 has a tubular shape and has a tubular hole 47*v* into which the application body 1 is inserted. The scraping member 47 has an inclined surface 47*t* that is in contact with the cosmetic M, and the inclined surface 47*t* is inclined outwardly and rearwardly, namely to the outside of the scraping member 47 in the radial direction D2 as the inclined surface 47*t* extends away from the front portion of the filling member 45. For example, the inclined surface 47*t* extends along the increased diameter portion 45*k* of the filling member 45, and may extend parallel to the increased diameter portion 45*k*.

As described above, in the cosmetic container 100C, the scraping member 47 has the tubular hole 47*v* into which the application body 1 is inserted. Therefore, the cosmetic M scraped by the scraping member 47 can be more easily guided to the application body 1 inserted into the tubular hole 47*v* of the scraping member 47, so that similarly to the above-described example, the residual amount of the filled cosmetic M can be reduced.

Figure 16A:
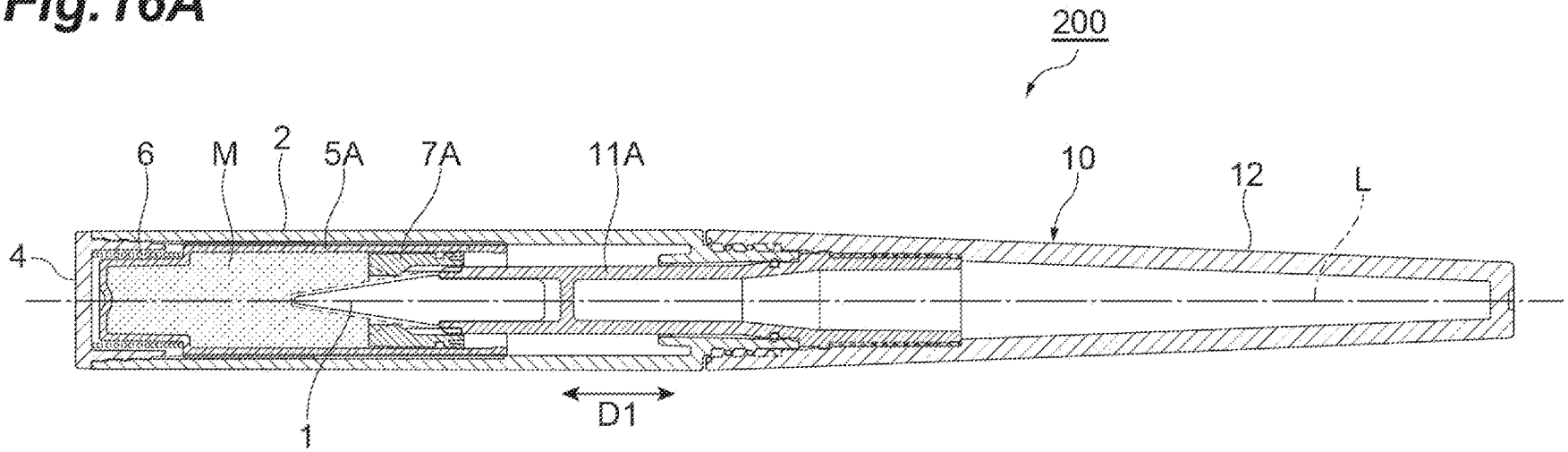
FIG. 16A is a cross-sectional view illustrating a cosmetic container according to another example.
Figure 16B:
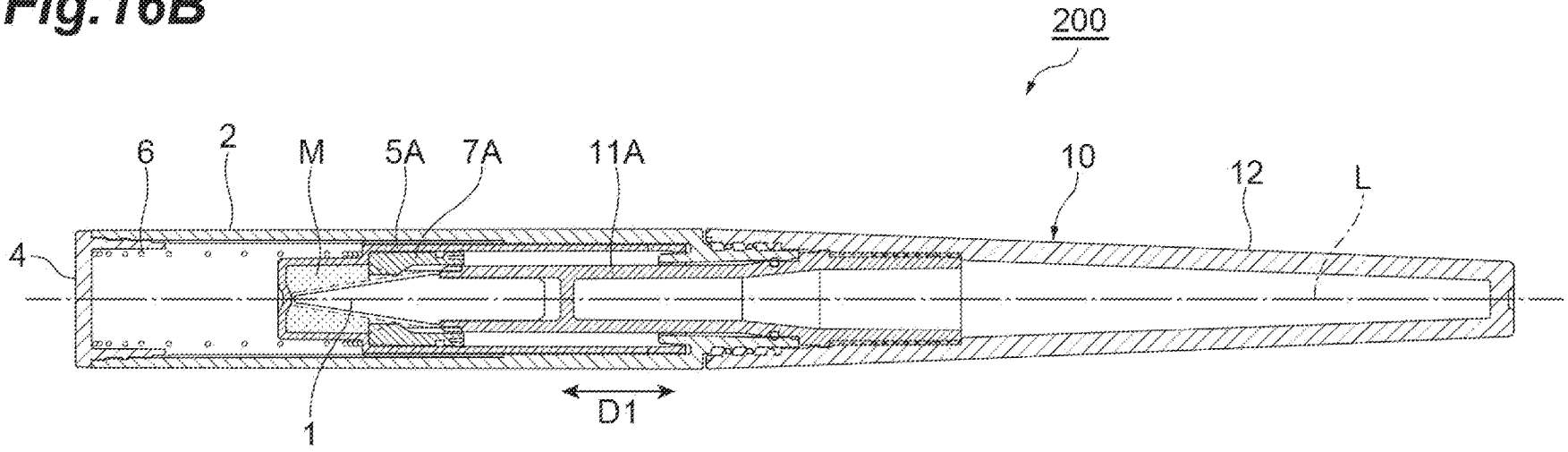
FIG. 16B is a cross-sectional view of the cosmetic container of FIG. 16A, illustrating a state where an amount of a cosmetic contained in the cosmetic container has decreased.

FIGS. 16A and 16B are longitudinal cross-sectional views illustrating a cosmetic container 200 according to another example.

Some configurations of the cosmetic container 200 are similar to configurations of the example cosmetic container 100 described above, the similar elements are denoted by the same reference signs as those of elements of the cosmetic container 100, and overlapping description of the cosmetic container 100 may be omitted. The cosmetic container 200 is configured such that the container main body 10 including the sleeve 12 holds the application body 1 and application can be performed by the application body 1 in a state where the application body 1 of the container main body 10 is removed from the cap 2.

The tail plug 4 is fitted into the front end of the cap 2 in the axial direction D1. A filling member 5A filled with the cosmetic M, the spring 6 that biases the filling member 5A toward the container main body 10 (application body 1), and a scraping member 7A having a tubular shape that scrapes the cosmetic M inside the filling member 5A are provided inside the cap 2. The scraping member 7A is movable in the axial direction D1 and is rotatable around the axis L of the cosmetic container 200 inside the filling member 5A. The scraping member 7A is different from the scraping member 7 in that the scraping member 7A does not include the elastic portion 7*c* that the scraping member 7 described above includes. For example, the scraping member 7A includes only a configuration corresponding to the slider 7*b* of the scraping member 7 described above.

Figure 17:
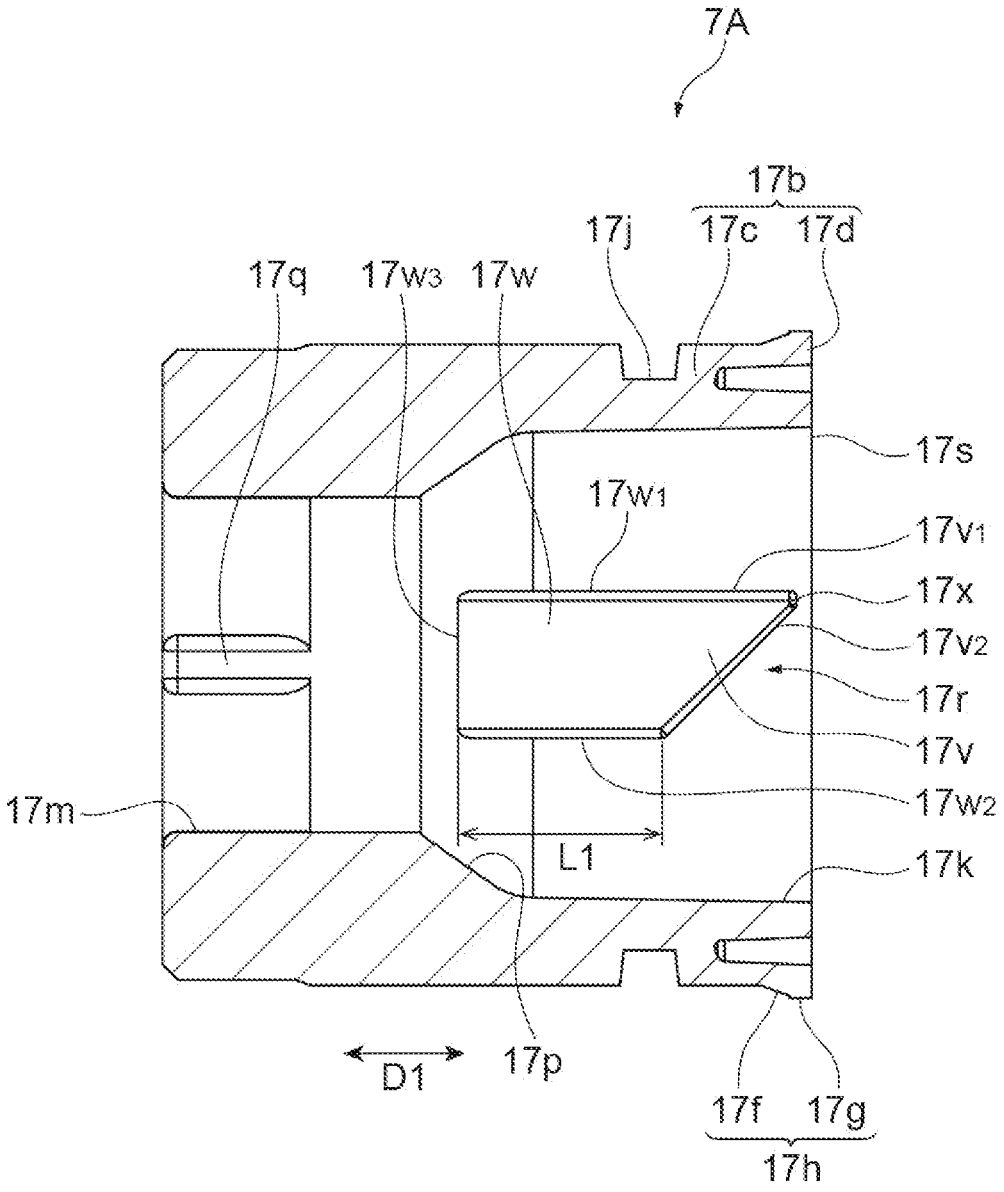
FIG. 17 is a cross-sectional view of a scraping member of the cosmetic container illustrated in FIG. 16A.
Figure 18A:
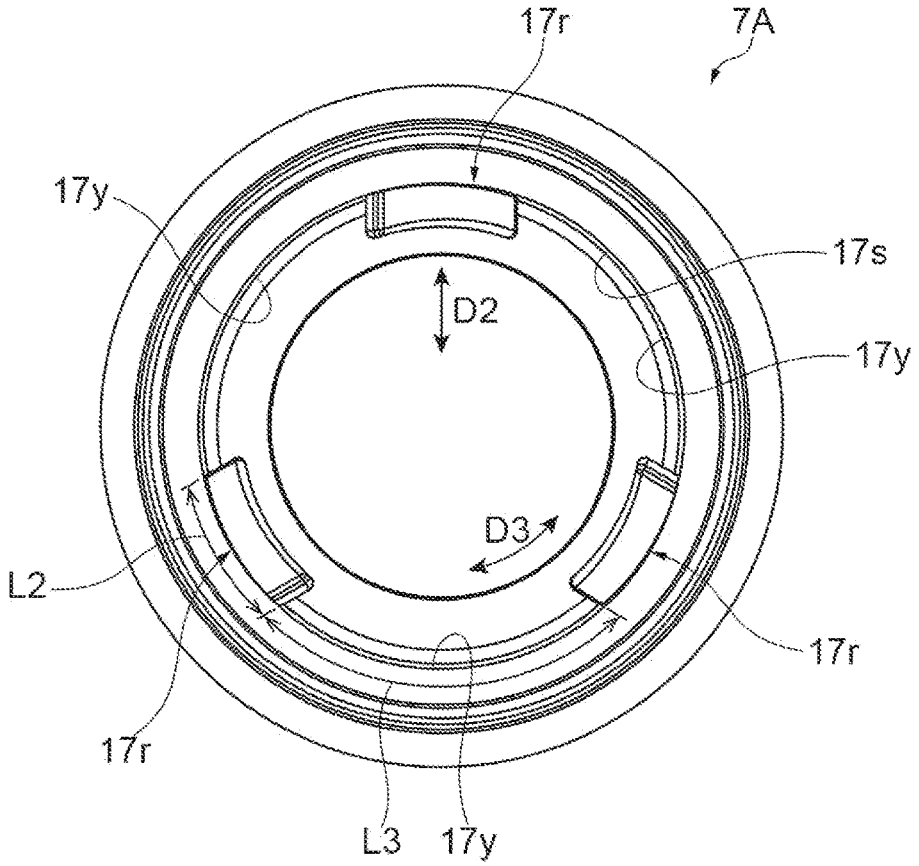
FIG. 18A is a rear view of the scraping member of FIG. 17.
Figure 18B:
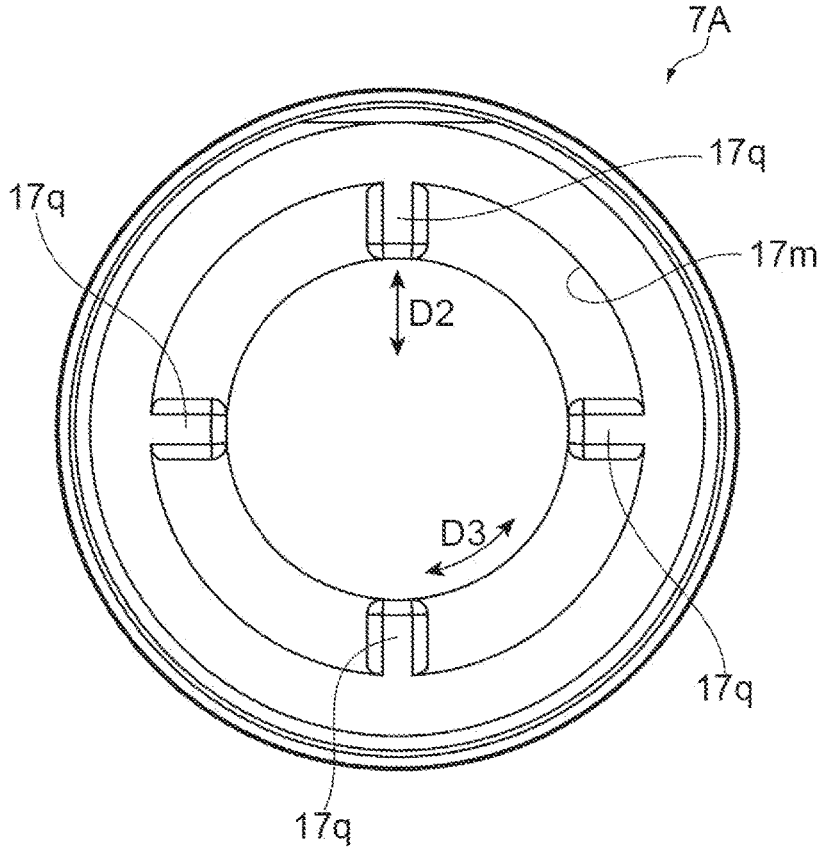
FIG. 18B is a front view of the scraping member of FIG. 17.

FIG. 17 is a cross-sectional view illustrating the scraping member 7A. FIG. 18A is a rear view of the scraping member 7A when viewed from the rear side in the axial direction D1. FIG. 18B is a front view of the scraping member 7A when viewed from the front side in the axial direction D1. With reference to FIGS. 17, 18A and 18B, the scraping member 7A includes a protrusion portion 17*b* located at the rear end of the scraping member 7A, that slides along an inner surface of the filling member 5A. For example, the protrusion portion 17*b* is formed on an outer side in the radial direction D2 at an opening 17*s* located on the rear-end side in the axial direction D1.

The protrusion portion 17*b* includes a first protrusion portion 17*c* protruding in the radial direction D2, and a second protrusion portion 17*d* protruding from an outer side of the first protrusion portion 17*c* in the radial direction D2 to the rear end of the scraping member 7A in the axial direction D1. A sliding portion 17*h* extends from the second protrusion portion 17*d* in the axial direction D1, the sliding portion 17*h* including an inclined surface 17*f* that extends obliquely outwardly in the radial direction D2 and a top surface 17*g* extending in the axial direction D1 at an outer edge portion of the inclined surface 17*f* in the radial direction D2.

The scraping member 7A includes an annular recess 17*j* extending along a circumferential direction D3 of the scraping member 7A, on a front side of the protrusion portion 17*b*, in the axial direction D1. An O-ring can be fitted into the annular recess 17*j*. The O-ring is fitted into the annular recess 17*j*, so that leakage of the cosmetic M from the inner surface of the filling member 5A can be more reliably suppressed. In some examples, no O-ring is fitted into the annular recess 17*j*.

The scraping member 7A has a first inner surface 17*k* located at a rear portion of the scraping member 7A, a second inner surface 17*m* located at a front portion of the scraping member 7A, and an inclined surface 17*p* that connects the first inner surface 17*k* and the second inner surface 17*m* to each other. For example, an inner diameter of the first inner surface 17*k* is larger than an inner diameter of the second inner surface 17*m*, and an inner diameter of the inclined surface 17*p* is reduced as the inclined surface 17*p* extends from the first inner surface 17*k* toward the second inner surface 17*m*.

A protrusion 17*q* protruding inwardly in the radial direction D2 is formed on the second inner surface 17*m*. The protrusion 17*q* is provided to crush the cosmetic M inside the scraping member 7A with the movement and rotation of the scraping member 7A. The protrusion 17*q* has a linear shape extending in the axial direction D1 and in some examples, may extend linearly along the axial direction D1. A length of the protrusion 17*q* in the axial direction D1 is longer than a width of the protrusion 17*q* (namely, a length of the protrusion 17*q* in the circumferential direction D3). The scraping member 7A includes, for example, a plurality of the protrusions 17*q*, and the plurality of protrusions 17*q* are arranged along the circumferential direction D3. As an example, four protrusions 17*q* are arranged at equal intervals along the circumferential direction D3.

Ratchet teeth 17*r* (second ratchet teeth) are formed in the first inner surface 17*k*. A shaft portion 11A of the container main body 10 described further below, engages with the ratchet teeth 17*r*. The scraping member 7A includes, for example, three ratchet teeth 17*r*. However, the number of the ratchet teeth 17*r* may be 6, for example, and is not particularly limited. For example, the three ratchet teeth 17*r* may be disposed at equal intervals along the circumferential direction D3 of the scraping member 7A.

For example, the ratchet teeth 17*r* extend from the first inner surface 17*k* to the inclined surface 17*p* along the axial direction D1. Namely, a part of each of the ratchet teeth 17*r* reaches the inclined surface 17*p*. Each of the ratchet teeth 17*r* includes an inclined portion 17*v* located on an opening 17*s* side, and a linear portion 17*w* extending from the inclined portion 17*v* to a side opposite the opening 17*s* along the axial direction D1. The inclined portion 17*v* may have, for example, the same shape as that of each of the ratchet teeth 7*j* of the scraping member 7 described above. For example, the inclined portion 17*v* may include a first side 17*v*1 extending linearly from a tip (or rear-end tip) 17*x* (e.g., on the opening 17*s* side) of each of the ratchet teeth 17*r* in the axial direction D1, and an inclined side 17*v*2 that is inclined with respect to the axial direction D1 such that a width of each of the ratchet teeth 17*r* from the tip 17*x* (length in the circumferential direction D3) is increased.

The linear portion 17*w* is, for example, a straight portion extending linearly along the axial direction D1. For example, the linear portion 17*w* may include a second side 17*w*1 extending continuously from the first side 17*v*1, a third side 17*w*2 extending from an end portion of the inclined side 17*v*2 opposite the tip 17*x* in the axial direction D1, and a fourth side 17*w*3 that connects the second side 17*w*1 and the third side 17*w*2 to each other. The fourth side 17*w*3 connects an end portion of the second side 17*w*1 opposite the tip 17*x* and an end portion of the third side 17*w*2 opposite the tip 17*x* to each other. The second side 17*w*1, the third side 17*w*2, and the fourth side 17*w*3 form, for example, a rectangular shape. In this case, the second side 17*w*1 and the third side 17*w*2 extend parallel to each other, and the fourth side 17*w*3 extends along the circumferential direction D3.

According to examples, the scraping member 7A includes a plurality of the ratchet teeth 17*r*, and the plurality of ratchet teeth 17*r* are arranged along the circumferential direction D3. The ratchet teeth 17*r* each have a protruding shape protruding inwardly in the radial direction D2. For example, a groove 17*y* that is recessed with respect to the ratchet teeth 17*r* is formed between a pair of the ratchet teeth 17*r* arranged along the circumferential direction D3.

In some examples, a length L1 of the linear portion 17*w* in the axial direction D1 is longer than a length L2 of the linear portion 17*w* in the circumferential direction D3. In some examples, the length L2 of each of the ratchet teeth 17*r* (linear portion 17*w*) in the circumferential direction D3 is shorter than a length L3 of the groove 17*y* in the circumferential direction D3. Namely, in a region along the circumferential direction D3 on the scraping member 7A, an area of a region occupied by the groove 17*y* is wider than an area of a region occupied by the ratchet teeth 17*r*.

Figure 19A:
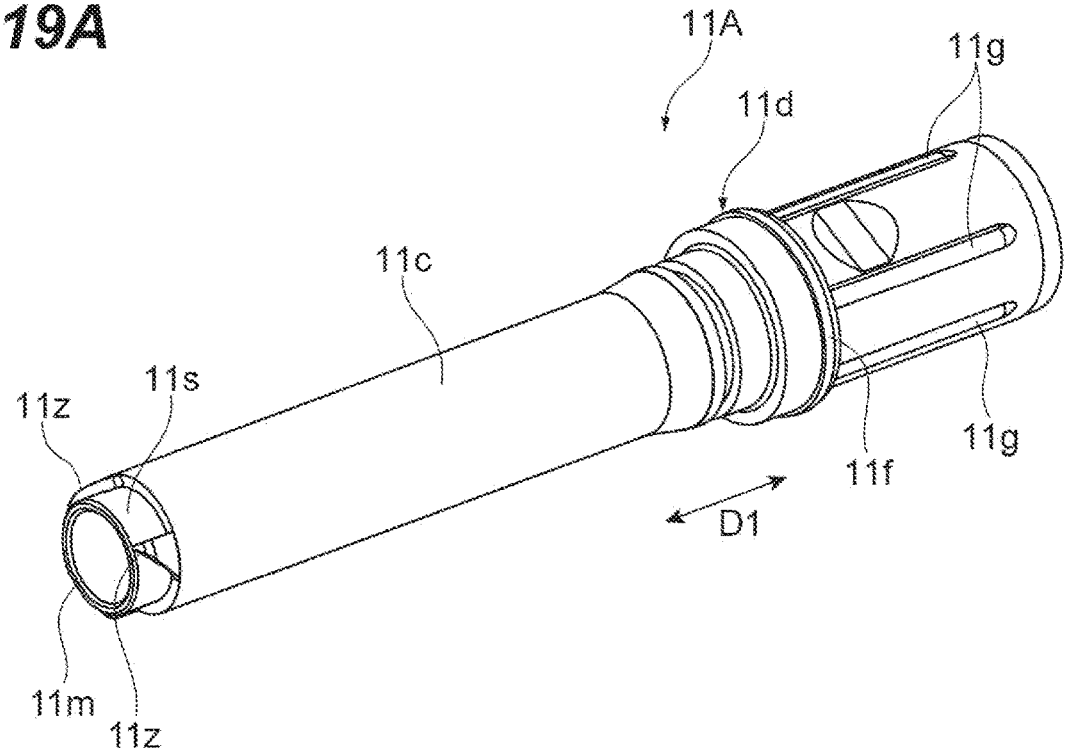
FIG. 19A is a perspective view of a shaft portion of the cosmetic container illustrated in FIG. 16A.
Figure 19B:
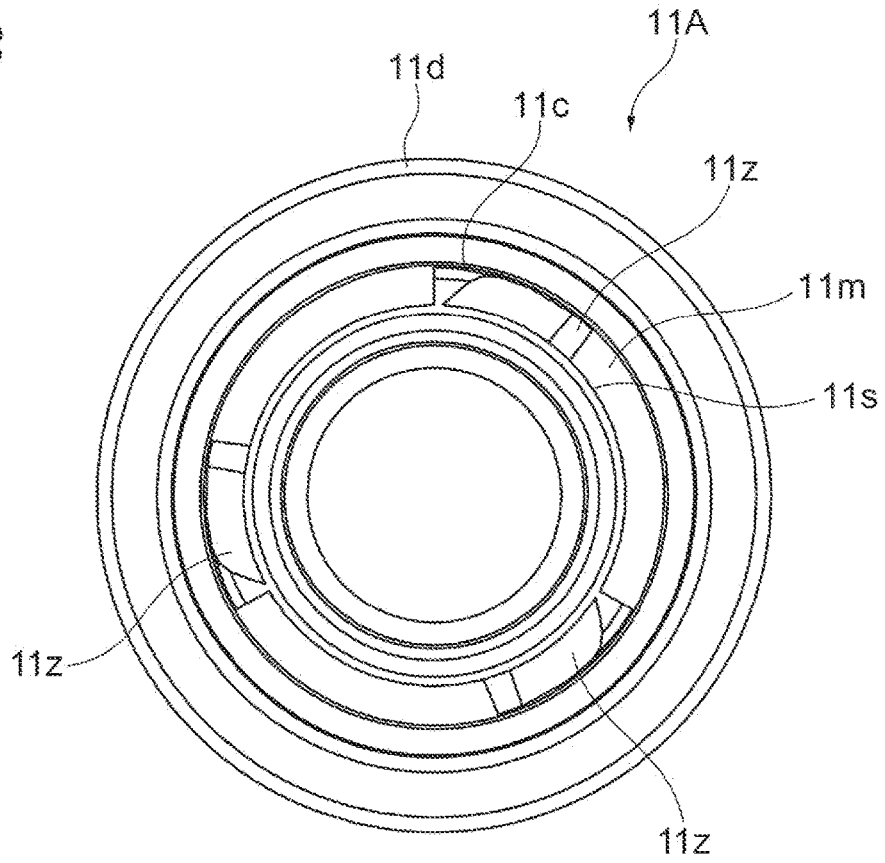
FIG. 19B is a front view of the shaft portion of FIG. 19A.

In the present example, the container main body 10 includes the shaft portion 11A that is different from the shaft portion 11 described above. FIG. 19A is a perspective view illustrating the shaft portion 11A. With reference to FIG. 19A, the shaft portion 11A has a stepped cylindrical shape including the reduced diameter portion 11*c* at the front portion and including the increased diameter portion 11*d* at the rear portion. The annular protrusion 11*f* and the projection 11*g* are formed on the outer surface of the increased diameter portion 11*d*. A disposition of the annular protrusion 11*f* and the projection 11*g* in the shaft portion 11A may be similar to the disposition of the annular protrusion 11*f* and the projection 11*g* in the shaft portion 11 described above.

Ratchet teeth 11*z* (first ratchet teeth) located at the front end 11*m* of the shaft portion 11A are formed in the outer surface of the reduced diameter portion 11*c*. For example, the small diameter portion 11*s* that is further reduced in diameter relative to the reduced diameter portion 11*c* is formed at the front end 11*m* of the shaft portion 11A, and the ratchet teeth 11*z* are formed in the small diameter portion 11*s*. For example, a shape of each of the ratchet teeth 11*z* is the same as a shape of each of the ratchet teeth 11*r* of the shaft portion 11 described above. In some examples, the number of the ratchet teeth 11*z* is different from the number of the ratchet teeth 11*r*. For example, the number of the ratchet teeth 11*z* is 3, but may be 6 and can be appropriately changed depending on examples.

As described above with reference to FIGS. 16A, 16B, 17, 18A and 18B, in the cosmetic container 200, each of the ratchet teeth 17*r* of the scraping member 7A includes the linear portion 17*w* extending along the axial direction D1.

The length L1 of the linear portion 17*w* in the axial direction D1 is longer than the length L2 of the linear portion 17*w* in the circumferential direction D3 of the scraping member 7A.

Various embodiments and modification examples of the cosmetic container according to the present disclosure have been described above. However, the cosmetic container according to the present disclosure is not limited to the above-described examples, and may be further modified without departing from the present disclosure. For example, the shapes, the sizes, the number, the materials, and the mode of disposition of the components forming the example cosmetic containers can be appropriately changed without departing from the present disclosure.

For example, in the above-described examples, the scraping member 7 has been described in which the slider 7*b* and the elastic portion 7*c* are separate. However, the cosmetic container may include a scraping member in which a slider and an elastic portion are integrally formed into a single component, instead of the scraping member 7. In addition, a scraping member of which a part serves as an elastic portion may be provided, or a scraping member of which the entirety serves as an elastic portion may be provided. Further, when there is no concern about leakage of the cosmetic M, the elastic portion can also be omitted.

In the above-described examples, the scraping member 7 has been described which rotates relative to the shaft portion 11 when the sleeve 12 is opened and which rotates synchronously with the shaft portion 11 when the sleeve 12 is closed. However, the scraping member may rotate synchronously with the shaft portion when the sleeve is opened (e.g., unscrewed) and rotate relative to the shaft portion when the sleeve is closed (e.g., screwed). In such a manner, the timing of rotation of the scraping member can be appropriately changed. Further, the scraping member may not rotate with respect to the filling member or may not move in the axial direction.

In the above-described examples, the cosmetic container 100 has been described in which the spring 6 biases the filling member 5 in the axial direction D1. However, the spring 6 that biases the filling member 5 in the axial direction D1 may be omitted, and the biasing device for biasing the application body 1 in the axial direction D1 may be provided in the container main body 10. In such a manner, the configuration of the biasing device and the container main body can be appropriately changed.

In the above-described examples, the filling member 5 has been described which includes the bottom portion 5*j* in which the protrusion portion 5*f* is formed. However, for example, the cosmetic container may include a filling member that does not include the protrusion portion 5*f* at a bottom portion, and the shape and the size of the bottom portion of the filling member can be appropriately changed without departing from the present disclosure. The shape and the like of the filling member can also be appropriately changed.

In the above-described examples, the scraping member 7 has been described which is provided inside the filling member 5. However, the cosmetic container may include a scraping member of which a part is provided outside the filling member, and a disposition of the scraping member may be appropriately changed. In such a manner, the configurations of and the disposition of the filling member and the scraping member can be appropriately changed.

Figure 20A:
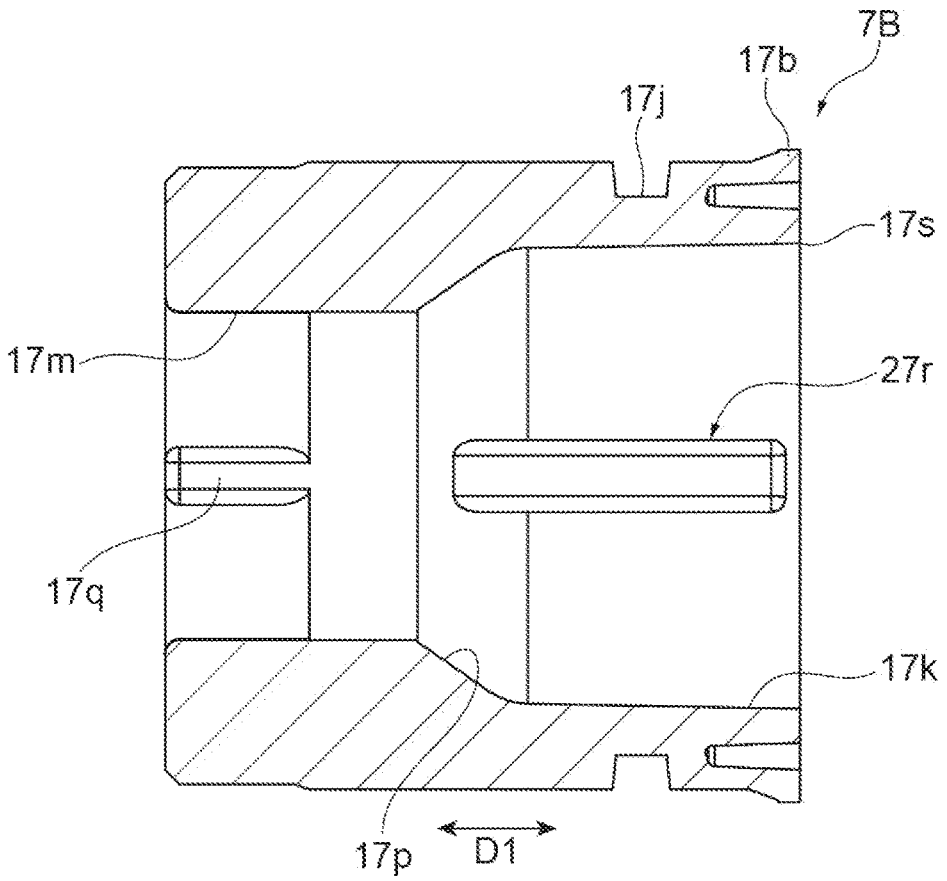
FIG. 20A is a cross-sectional view of a scraping member according to a modified example.
Figure 20B:
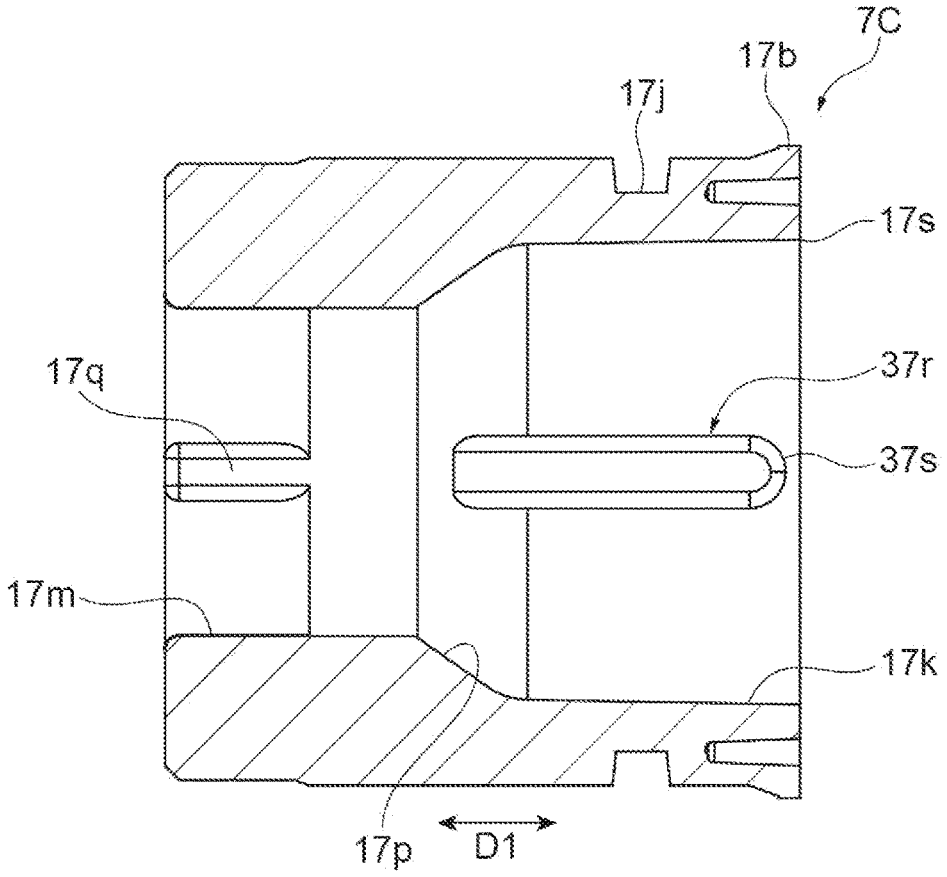
FIG. 20B is a cross-sectional view of a scraping member according to a further modified example.

In the above-described examples, the scraping member 7A has been described which includes the ratchet teeth 17*r* each including the inclined portion 17*v* and the linear portion 17*w*. However, the shape of each of the ratchet teeth of the scraping member is not limited to the above-described example. For example, with reference to FIG. 20A, a scraping member 7B may be provided which includes ratchet teeth 27*r* each having a rectangular shape and not including the inclined portion 17*v*. A length of each of the ratchet teeth 27*r* in the axial direction D1 is longer than a length of each of the ratchet teeth 27*r* in the circumferential direction D3, and the ratchet teeth 27*r* extend linearly in the axial direction D1. With reference to FIG. 20B, a scraping member 7C may be provided which includes ratchet teeth 37*r*, with each ratchet tooth 37*r* having a curved portion 37*s* protruding in the axial direction D1 at a rear end of the ratchet tooth 37*r*. For example, the curved portion 37*s* is formed at the rear end (e.g., on the opening 17*s* side) of the scraping member 7C, to exhibit, for example, a circular arc shape. In such a manner, the shape and the size of each of the ratchet teeth can be appropriately changed.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A cosmetic container comprising:

an application body configured to hold a cosmetic and to apply the cosmetic to a surface;

a container main body holding the application body;

a cap detachably mounted to the container main body;

a filling member located inside the cap and forming a filling region to contain the cosmetic, wherein the filling region has a diameter that is greater than a maximum diameter of the application body, and wherein the filling member includes an open end to insert the application body and a closed end opposite the open end; and a scraping member extending at least partially into the filling member to scrape the cosmetic stored in the filling region, wherein the scraping member forms a tubular hole to insert the application body into the filling region, and wherein an inner surface of the scraping member forming the tubular hole includes an inclined surface that extends radially outwardly toward the closed end of the filling member.

2. The cosmetic container according to claim 1, wherein the scraping member is movable in an axial direction and is rotatable in a circumferential direction of the filling member with respect to the filling member.

3. The cosmetic container according to claim 1, further comprising:

a biasing device located inside the cap to urge the filling member toward the container main body.

4. The cosmetic container according to claim 1, wherein the closed end has a diameter that corresponds to the diameter of the filling region that is greater than the maximum diameter of the application body, and wherein the closed end of the filling member includes a protrusion portion protruding away from the open end of the filling member, wherein the protrusion portion has a shape that conforms to an outer shape of the application body.

5. A cosmetic container comprising:

an application body configured to hold a cosmetic and to apply the cosmetic to a surface;

a container main body including a shaft portion holding the application body and extending from the application body in an axial direction of the container main body, wherein the shaft portion includes first ratchet teeth;

a cap detachably mounted to the container main body;

a filling member located inside the cap and forming a filling region to contain the cosmetic, wherein the filling region has a diameter that is greater than a maximum diameter of the application body; and a scraping member extending at least partially into the filling member to scrape the cosmetic stored in the filling region, wherein the scraping member forms a tubular hole to insert the application body into the filling region, wherein the scraping member includes second ratchet teeth that engage with the first ratchet teeth of the container main body, and wherein the first ratchet teeth and the second ratchet teeth form a ratchet mechanism that allows a relative rotation between the shaft portion and the scraping member in a first direction and that restricts a relative rotation between the shaft portion and the scraping member in a second direction opposite to the first direction, so that the second direction of rotation causes the scraping member to rotate synchronously with the shaft portion to scrape the cosmetic in the filling region of the filling member.

6. The cosmetic container according to claim 5, wherein each of the second ratchet teeth of the scraping member includes a linear portion extending along the axial direction.

7. The cosmetic container according to claim 6, wherein a length of the linear portion in the axial direction is longer than a length of the linear portion in a circumferential direction of the scraping member.

8. The cosmetic container according to claim 5, wherein the scraping member is movable in an axial direction and is rotatable in a circumferential direction of the filling member with respect to the filling member.

9. The cosmetic container according to claim 5, further comprising:

a biasing device located inside the cap to urge the filling member toward the container main body.

10. The cosmetic container according to claim 5, wherein the filling member includes an open end to insert the application body and a closed end opposite the open end, wherein the closed end has a diameter that corresponds to the diameter of the filling region that is greater than the maximum diameter of the application body, and wherein the closed end of the filling member includes a protrusion portion protruding away from the open end of the filling member, wherein the protrusion portion has a shape that conforms to an outer shape of the application body.

11. A cosmetic container comprising:

an application body configured to hold a cosmetic and to apply the cosmetic to a surface;

a container main body holding the application body;

a cap detachably mounted to the container main body;

a filling member located inside the cap and forming a filling region to contain the cosmetic, wherein the filling region has a diameter that is greater than a maximum diameter of the application body; and a scraping member extending at least partially into the filling member to scrape the cosmetic stored in the filling region, wherein the scraping member includes:

a slider having a tubular shape that forms a tubular hole to insert the application body into the filling region; and an elastic portion located between the slider and an inner surface of the filling member, so as to contact the inner surface of the filling member.

12. The cosmetic container according to claim 11, wherein the scraping member is movable in an axial direction and is rotatable in a circumferential direction of the filling member with respect to the filling member.

13. The cosmetic container according to claim 11, further comprising:

a biasing device located inside the cap to urge the filling member toward the container main body.

14. The cosmetic container according to claim 11, wherein the filling member includes an open end to insert the application body and a closed end opposite the open end, wherein the closed end has a diameter that corresponds to the diameter of the filling region that is greater than the maximum diameter of the application body, and wherein the closed end of the filling member includes a protrusion portion protruding away from the open end of the filling member, wherein the protrusion portion has a shape that conforms to an outer shape of the application body.

* * * * *